US005597682A

United States Patent [19]

Ishii et al.

[11] Patent Number: 5,597,682

[45] Date of Patent: Jan. 28, 1997

[54] SILVER HALIDE COLOR PHOTOGRAPHIC MATERIAL

[75] Inventors: Yoshio Ishii; Keiji Mihayashi; Masakazu Morigaki, all of Kanagawa, Japan

[73] Assignee: Fuji Photo Film Co., Ltd., Kanagawa, Japan

[21] Appl. No.: 371,418

[22] Filed: Jan. 11, 1995

[30] Foreign Application Priority Data

Jan. 25, 1994 [JP] Japan ..... 6-006384

[51] Int. Cl.[6] ..... G03C 1/795

[52] U.S. Cl. ..... 430/533; 430/523; 430/534; 430/535; 430/600

[58] Field of Search ..... 430/533, 600, 430/523, 534, 535; 428/46

[56] References Cited

U.S. PATENT DOCUMENTS

| | | | |
|---|---|---|---|
| 3,875,119 | 4/1975 | Aoki et al. | 260/75 T |
| 4,054,458 | 10/1977 | Ohtani et al. | 430/600 |
| 4,141,735 | 2/1979 | Schrader et al. | 430/141 |
| 5,294,473 | 3/1994 | Kawamoto | 430/533 |
| 5,368,997 | 11/1994 | Kawamoto | 430/533 |
| 5,380,577 | 1/1995 | Hamano et al. | 428/143 |

FOREIGN PATENT DOCUMENTS

| | | | |
|---|---|---|---|
| 0319030 | 12/1989 | Japan | 430/600 |
| 0365032 | 12/1992 | Japan | 430/600 |

*Primary Examiner*—Hoa Van Le

*Attorney, Agent, or Firm*—Sughrue, Mion, Zinn, Macpeak & Seas

[57] ABSTRACT

A silver halide color photographic material is described, which comprises a support having thereon at least one photographic layer, wherein at least one of said photographic layers contains at least one radical scavenger, and the support comprises a poly(alkylene aromatic dicarboxylate) whose glass transition point is from 50° to 200° C. and has been subjected to a heat treatment at a temperature of lower than the glass transition point thereof and not lower than 40° C. either before formation of a subbing layer or after formation of a subbing layer and before formation of a silver halide emulsion layer.

4 Claims, No Drawings

SILVER HALIDE COLOR PHOTOGRAPHIC MATERIAL

FIELD OF THE INVENTION

This invention relates to a silver halide color photographic material. More particularly, it relates to a silver halide color photographic material which is prevented from undergoing change in photographic performance with time from photographing to development processing, prevented from suffering processing unevenness at the time of development, and prevented from being stained with the elapse of time after development processing.

BACKGROUND OF THE INVENTION

Photographic materials are generally produced by forming at least one light-sensitive layer on a plastic film support.

Practically employed plastic films are cellulose polymers, such as triacetyl cellulose (hereafter abbreviated as TAC), and polyester polymers, such as polyethylene terephthalate (hereinafter abbreviated as PET).

In general, the forms of photographic materials are divided into sheets, such as X-ray films, plate making films, and cut films; and rolls, such as 35 mm or less wide color or black-and-white negative films for photographing packed in a patrone or a cartridge to be loaded into ordinary cameras.

A TAC film chiefly used as a support of roll films are characterized primarily by freedom from optical anisotropy and high transparency and secondarily by its property of eliminating curl after development processing. That is, since a TAC film exhibits relatively high water absorption as a plastic film in the nature of its molecular structure, the molecular chain once fixed to set the curl which occurred with time during storage in a roll form is made to flow and re-arranged upon absorption of water during development processing. As a result, the curl once set can be eliminated.

On the other hand, it is very likely that a TAC film also absorbs, because of its high water absorption, components of a processing solution which may have an adverse action in the subsequent processing steps or a drying step or even thereafter. For example, a color developing agent, if adsorbed in a support and is not completely washed away in a washing step, causes color stain with time. In case where a photographic material containing a coloring material, such as a dye, is continuously processed, a support may absorb the coloring material dissolved into a processing solution and is stained. These problems will become acuter with the decreasing rate of replenishment for consideration of environmental conservation and simplification of processing.

A less water-absorbing support, such as a PET film, gives rise to no such problems but, when used in a roll form, causes various problems due to the set curl, such as jamming or processing unevenness at the time of development, especially in mini lab.

Further, it has turned out that a photographic material using a support made of a poly(alkylene aromatic dicarboxylate) like a PET support tends to suffer changes in photographic performance with time after photographing up to development processing. This tendency is particularly conspicuous in cases where a poly(alkylene aromatic dicarboxylate) support is subjected to a heat treatment or a surface activation treatment, such as a corona discharge treatment, an ultraviolet treatment or a glow discharge treatment. It has therefore been demanded to make improvements in this point.

SUMMARY OF THE INVENTION

Accordingly, an object of the present invention is to provide a silver halide color photographic material which suffers little change in photographic performance with time after photographing up to development processing, which undergoes little processing unevenness at the time of development, and which is protected against staining after development processing.

The above object of the present invention is accomplished by a silver halide color photographic material comprising a support having thereon at least one photographic layer, wherein at least one of the photographic layers contains at least one radical scavenger, and the support comprises a poly(alkylene aromatic dicarboxylate) whose glass transition point is from 50° to 200° C. and has been subjected to a heat treatment at a temperature of lower than the glass transition point thereof and not lower than 40° C. either before formation of a subbing layer or after formation of a subbing layer and before formation of a silver halide emulsion layer.

DETAILED DESCRIPTION OF THE INVENTION

The present invention will be explained in more detail.

The terminology "radical scavenger" as used herein means a compound whose 2.5 $mmoldm^{-3}$ ethanol solution, when mixed with a 0.05 $mmoldm^{-3}$ ethanol solution of galvinoxyl at 25° C. by a stopped-flow method, substantially removes the color of galvinoxyl, i.e., reduces the absorbance at 430 nm, as confirmed by measurement of change in absorbance at 430 nm with time. A test compound which is not dissolved to the above-specified concentration may be tested at a lower concentration. A radical scavenger which is preferably used in the present invention has a galvinoxyl decoloration rate constant of 0.01 $mmol^{-1}s^{-1}dm^3$ or more, still preferably 0.1 $mmol^{-1}s^{-1}dm^3$ or more.

The method of obtaining a radical scavenging rate using galvinoxyl is described in *Microchemical Journal*, Vol. 31, pp. 18–21 (1985), and the stopped-flow method is described, e.g., in *Bunko Kenkyu*, Vol. 19, No. 6, p. 321 (1970).

Radical scavengers which are preferably used in the present invention include compounds represented by formula (A) or (B):

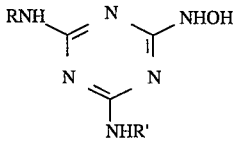

(A)

wherein R and R', which may be the same or different, each represent an alkyl group (e.g., methyl, ethyl, isopropyl, cyclopropyl, butyl, isobutyl, hexyl, cyclohexyl, t-octyl, decyl, dodecyl, hexadecyl or benzyl) or an aryl group (e.g., phenyl or naphthyl); provided that when R and R' are the same unsubstituted alkyl group, that alkyl group contains 7 or more carbon atoms,

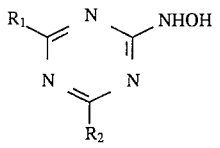

(B)

wherein $R_1$ and $R_2$, which may be the same or different, each represent a hydroxylamino group, a hydroxyl group, an amino group, an alkylamino group (e.g., methylamino, ethylamino, diethylamino, methylethylamino, propylamino, dibutylamino, cyclohexylamino, t-octylamino, dodecylamino, hexadecylamino, benzylamino or benzylbutylamino), an arylamino group (e.g., phenylamino, phenylmethylamino, diphenylamino or naphthylamino), an alkoxy group (e.g., methoxy, ethoxy, butoxy, t-butoxy, cyclohexyloxy, benzyloxy, octyloxy, tridecyloxy or hexadecyloxy), an aryloxy group (e.g., phenoxy or naphthoxy), an alkylthio group (e.g., methylthio, ethylthio, isopropylthio, butylthio, cyclohexylthio, benzylthio, t-octylthio or dodecylthio), an arylthio group (e.g., phenylthio or naphthylthio), an alkyl group (e.g., methyl, ethyl, propyl, butyl, cyclohexyl, isoamyl, sec-hexyl, t-octyl, dodecyl or hexadecyl), or an aryl group (e.g., phenyl or naphthyl); provided that $R_l$ and $R_2$ do not simultaneously represent —NHR, wherein R is an alkyl group or an aryl group.

In formulae (A) and (B), the groups represented by R, R', $R_1$, and $R_2$ may be each substituted with a substituent, such as an alkyl group, an aryl group, a heterocyclic group, a hydroxyl group, an alkoxy group, an aryloxy group, an alkylthio group, an arylthio group, an amino group, an acylamino group, a sulfonamido group, an alkylamino group, an arylamino group, a carbamoyl group, a sulfamoyl group, a sulfo group, a carboxyl group, a halogen atom, a cyano group, a nitro group, a sulfonyl group, an acyl group, an alkoxycarbonyl group, an aryloxycarbonyl group or an acyloxy group.

In formula (A), R and R' each preferably represent an alkyl group.

In formula (B), $R_1$ and $R_2$ each preferably represent a hydroxylamino group, an alkylamino group or an alkoxy group.

Of the compounds of formula (A) or (B) those having not more than 15 carbon atoms in total are preferred where radical scavenging action should be exerted on layers other than the layer where they are present, and those having 16 or more carbon atoms in total are preferred where radical scavenging action should be confined in the layer where they are present.

Of the compounds of formula (A) or (B), particularly preferred are those represented by formula (B'):

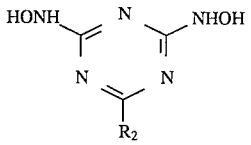

(B')

wherein $R_2$ has the same meaning as $R_2$ in formula (B) (the preference for $R_2$ in formula (B) also applies).

Specific examples of the compounds of formula (A) or (B) are shown below only for illustrative purposes but not for limitation.

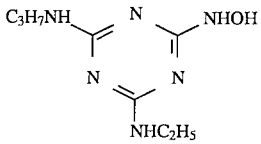

A-1

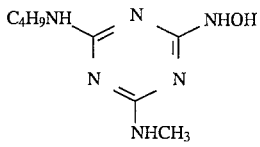

A-2

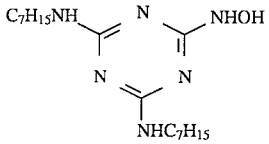

A-5

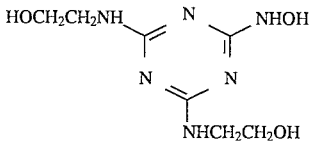

A-6

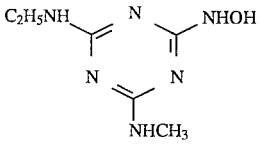

A-7

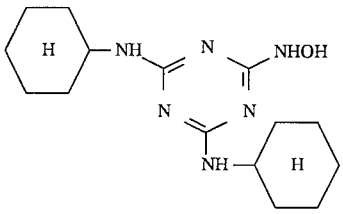

A-8

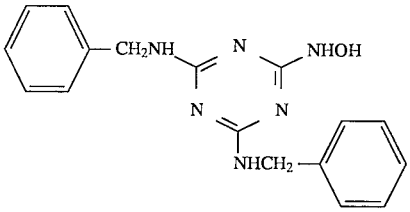

A-9

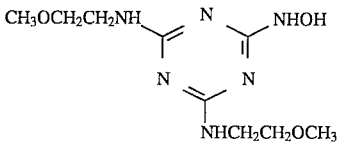

A-10

-continued
A-11
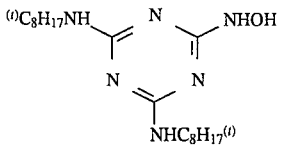
A-12
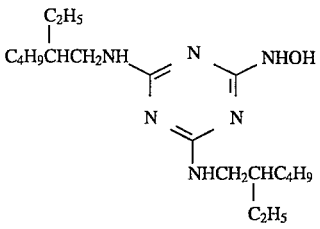
A-13
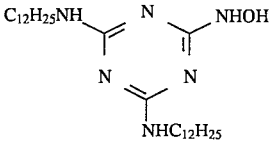
A-14
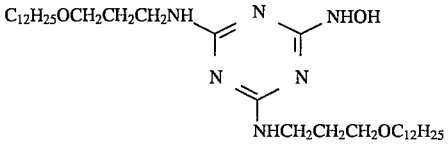
A-15
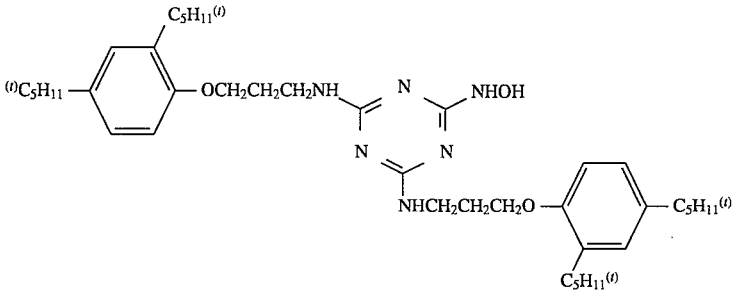
A-16
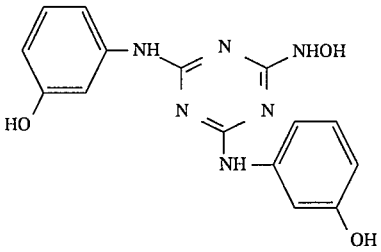
A-17
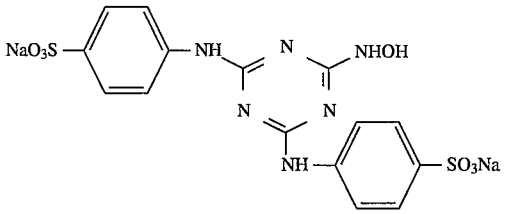
A-18
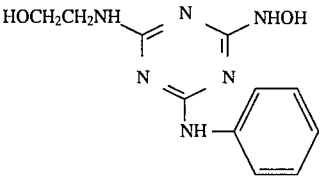
A-19
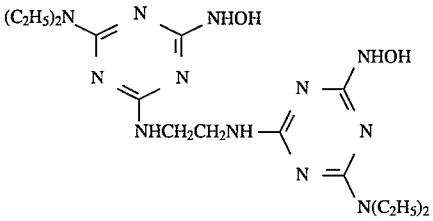
B-1
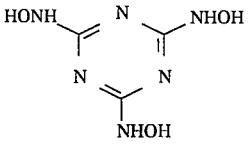
B-2
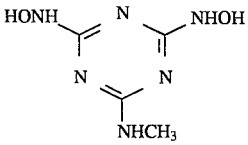
B-3
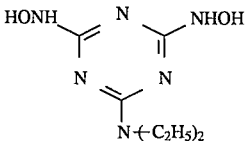
B-4
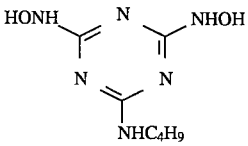
B-5
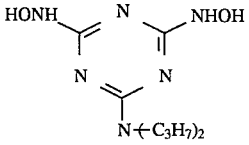
B-6
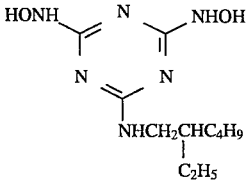

-continued
B-7
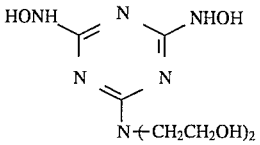
B-8
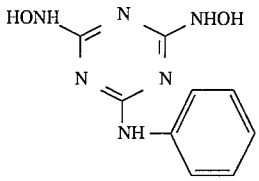
B-9
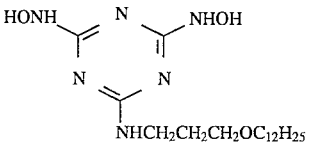
B-10
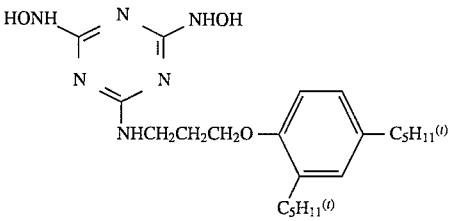
B-11
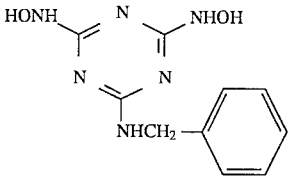
B-12
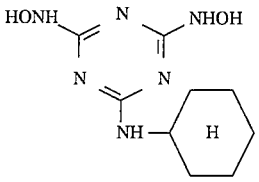
B-13
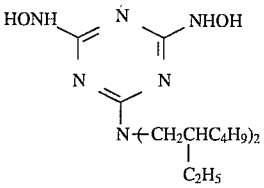
B-14
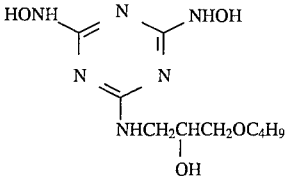
B-15
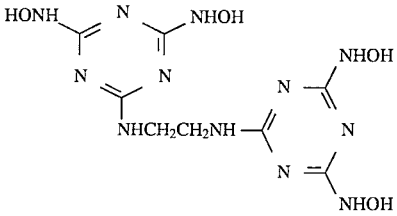
B-16
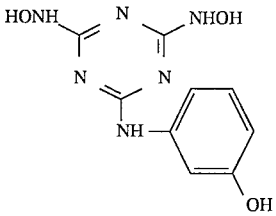
B-17
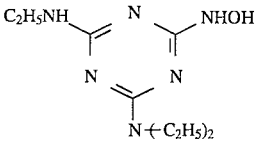
B-18
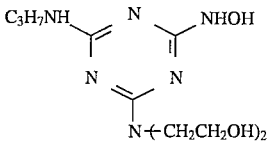
B-19
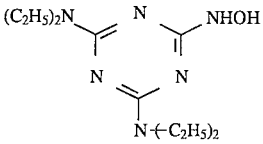
B-20
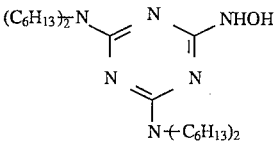
B-21
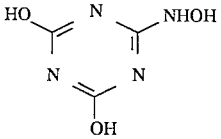
B-22
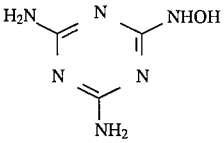
B-23
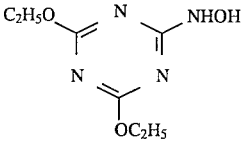
B-24
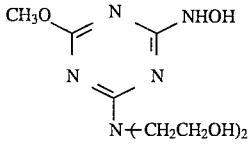

-continued

B-25

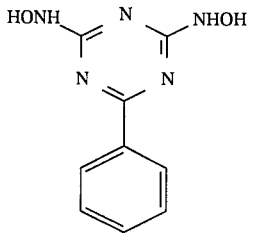

B-26

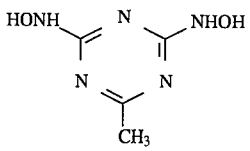

B-27

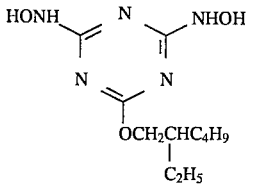

B-28

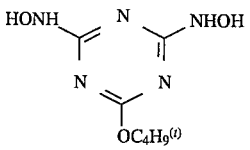

B-29

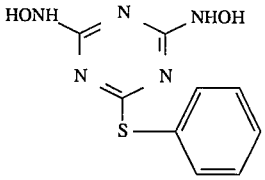

B-30

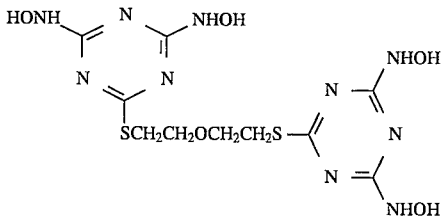

B-31

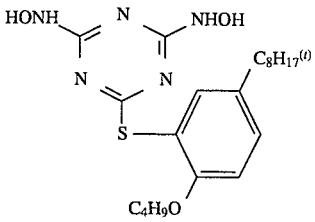

B-32

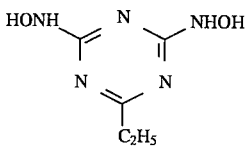

B-33

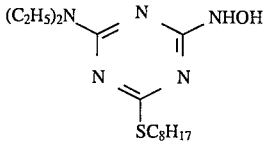

B-34

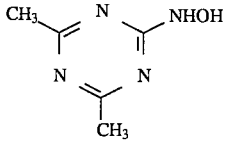

B-35

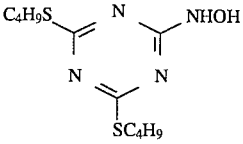

These compounds according to the present invention can easily be synthesized in accordance with the methods described in *J. Org. Chem.*, Vol. 27, p. 4054 (1962), *J. Amer. Chem. Soc.*, Vol. 73, p. 2981 (1951), and JP-B-49-10692 (the term "JP-B" as used herein means an "examined published Japanese patent application").

In Table 1 are shown the galvinoxyl decoloration rate constant of some of the radical scavengers useful in the present invention.

TABLE 1

| Compound | Decoloration Rate Constant ($mmol^{-1}s^{-1}dm^3$) |
|---|---|
| RS-1* | 0.3 |
| A-5 | 0.4 |
| A-15 | 0.5 |

TABLE 1-continued

| Compound | Decoloration Rate Constant ($mmol^{-1}s^{-1}dm^3$) |
|---|---|
| B-3 | 0.8 |
| B-10 | 0.9 |

Note:*

RS-1 is a radical scavenger represented by formula shown below, not included in formula (A) or (B):

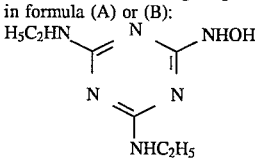

The radical scavenger is incorporated into a photographic layer either as a solution in water or a water-soluble solvent such as methanol or ethanol or as an emulsified dispersion.

When added as an aqueous solution, the radical scavenger may be dissolved in water at an appropriately adjusted pH in agreement with its pH-dependent water solubility. Where an aqueous solution of a water-soluble radical scavenger is added to one layer, the added radical scavenger substantially diffuses to other layers. The radical scavengers may be used either individually or in combination of two or more thereof.

The polyesters which can be used in the present invention will be described below.

Among various polyesters useful as a support in the present invention, preferred are those mainly comprising a benzenedicarboxylic acid or a naphthalenedicarboxylic acid and a diol for their high performance with a good balance between cost and resistance to curl and mechanical strength. In particular, polyethylene terephthalate (PET)-based polyesters and polyethylene naphthalate-based polyesters are preferred. The term "naphthalate" as used herein means "naphthalenedicarboxylate".

The polyesters according to the present invention are formed essentially of an aromatic dicarboxylic acid and a diol. The aromatic dicarboxylic acid is a dicarboxylic acid having at least one benzene nucleus and includes terephthalic acid, isophthalic acid, phthalic acid, phthalic anhydride, 1,4-, 1,5-, 2,6- or 2,7-naphthalenedicarboxylic acid, biphenyl-4,4'-dicarboxylic acid, tetrachlorophthalic anhydride, and compounds having the following formulae:

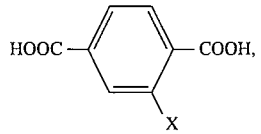

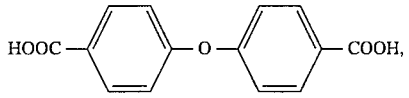

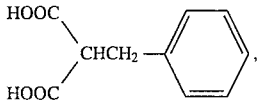

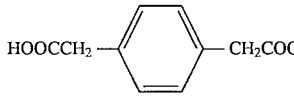

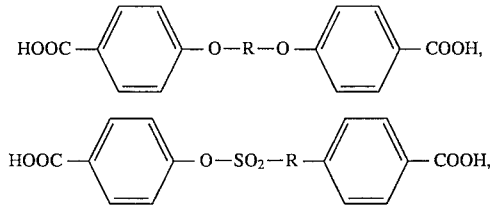

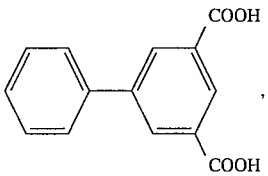

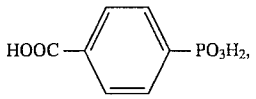

wherein X represents a halogen atom; and R represents an alkylene group having 1 to 5 carbon atoms.

Useful dibasic acids other than the essential aromatic dicarboxylic acids include succinic acid, glutaric acid, adipic acid, sebacic acid, succinic anhydride, maleic acid, fumaric acid, maleic anhydride, itaconic acid, citraconic anhydride, tetrahydrophthalic anhydride, 3,6-endomethylenetetrahydrophthalic anhydride, 1,4-cyclohexanedicarboxylic acid, and compounds having the following formulae:

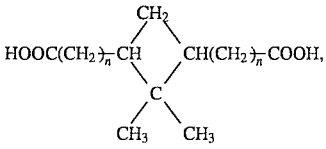

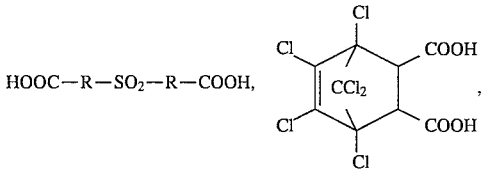

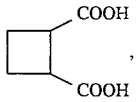

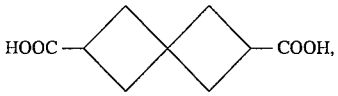

wherein n is 0 or 1; and R represents an alkylene group having 3 to 5 carbon atoms.

The diols include ethylene glycol, 1,3-propanediol, 1,2-propanediol, 1,4-butanediol, 1,5-pentanediol, 1,6-hexanediol, 1,7-heptanediol, 1,8-octanediol, 1,10-decanediol, 1,12-dodecanediol, 1,4-cyclohexanediol, 1,4-cyclohexanedimethanol, 1,3-cyclohexanediol, 1,1-cyclohexanedimethanol, catechol, resorcin, hydroquinone, 1,4-benzenedimethanol, and compounds having the following formulae:

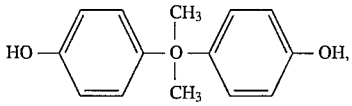

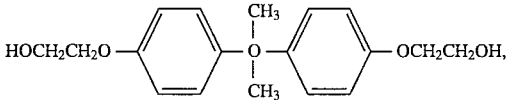

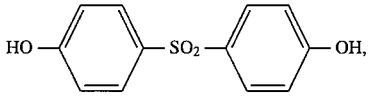

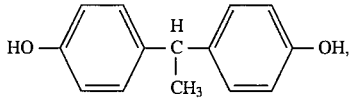

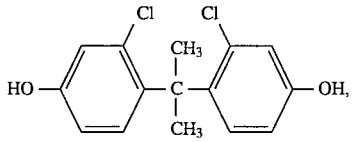

-continued

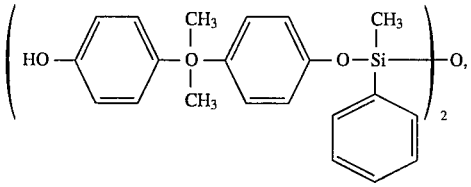

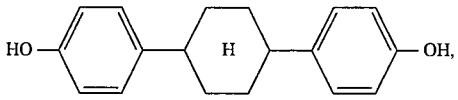

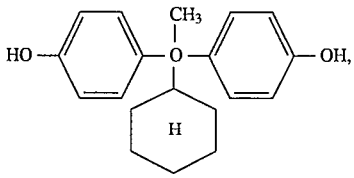

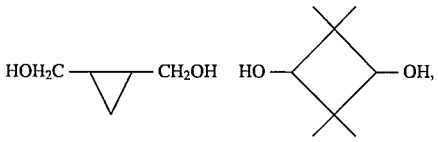

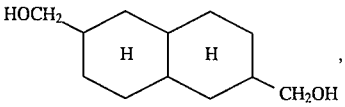

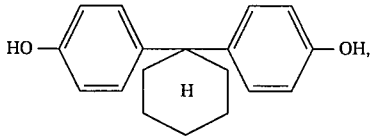

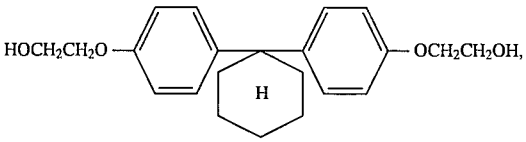

If desired, the polyester may comprise a monofunctional or tri- or higher polyfunctional hydroxyl-containing compound or acid-containing compound as a comonomer unit. The polyester may further comprise a compound having a hydroxyl group and a carboxyl group (or an ester thereof) in the molecule thereof as a comonomer unit. Examples of such a compound are shown below.

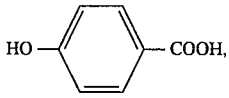

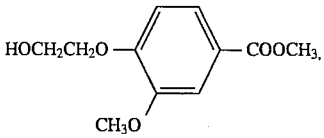

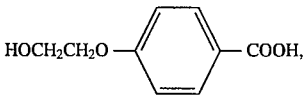

-continued

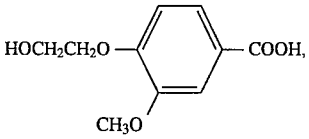

Of the polyesters comprising the above-mentioned diol and dicarboxylic acid, preferred are homopolymers, such as polyethylene terephthalate, polyethylene naphthalate, and polycyclohexanedimethanol terephthalate (PCT); and copolymers obtained from 2,6-naphthalenedicarboxylic acid (NDCA), terephthalic acid (TPA), isophthalic acid (IPA), orthophthalic acid (OPA) or biphenyl-4,4'-dicarboxylic acid (PPDC) as an aromatic dicarboxylic acid; ethylene glycol (EG), cyclohexanedimethanol (CHDM), neopentyl glycol (NPG), bisphenol A (BPA) or biphenyl (BP) as a diol; and p-hydroxy-benzoic acid (PHBA) or 6-hydroxy-2-naphthalenecarboxylic acid (HNCA) as a hydroxycarboxylic acid comonomer.

Still preferred among these polyesters are a copolymer of terephthalic acid, naphthalenedicarboxylic acid, and ethylene glycol (a mixing molar ratio of terephthalic acid and naphthalenedicarboxylic acid is preferably from 0.9:0.1 to 0.1:0.9, still preferably from 0.8:0.2 to 0.2:0.8), a copolymer of terephthalic acid, ethylene glycol, and bisphenol A (a mixing molar ratio of ethylene glycol and bisphenol A is preferably 0.6:0.4 to 0:1.0, still preferably 0.5:0.5 to 0.1:0.9), a copolymer of isophthalic acid, biphenyl-4,4'-dicarboxylic acid, terephthalic acid, and ethylene glycol (a molar ratio of isophthalic acid to terephthalic acid is preferably 0.1 to 0.5, still preferably 0.2 to 0.3, and that of biphenyl-4,4'-dicarboxylic acid to terephthalic acid is preferably 0.1 to 0.5, still preferably 0.2 to 0.3), a copolymer of terephthalic acid, neopentyl glycol, and ethylene glycol (a molar ratio of neopentyl glycol and ethylene glycol is preferably 1:0 to 0.7:0.3, still preferably 0.9:0.1 to 0.6:0.4), a copolymer of terephthalic acid, ethylene glycol, and biphenyl (a molar ratio of ethylene glycol to biphenyl is preferably 0:1.0 to 0.8:0.2, still preferably 0.1:0.9 to 0.7:0.3), and a copolymer of p-hydroxybenzoic acid, ethylene glycol, and terephthalic acid (a molar ratio of p-hydroxybenzoic acid to ethylene glycol is preferably 1:0 to 0.1:0.9, still preferably 0.9:0.1 to 0.2:0.8).

These homo- and copolymers can be synthesized in a conventional manner known for polyester production. For example, an acid component and a glycol component are directly esterified. In using a dialkyl ester as an acid component, it is subjected to interesterification with a glycol component, and the reaction mixture is heated under reduced pressure to remove the excess glycol component to obtain a desired polyester. The acid component may be once converted to an acid halide, which is then reacted with a glycol component. In these reactions, a catalyst for interesterification, a catalyst for polymerization or a thermal stabilizer may be used if desired. For the details of the polyester synthesis, reference can be made, e.g., in *Kobunshi Jikkengaku*, Vol. 5, "Jushukugo to Jufuka", pp. 103–136, Kyoritsu Shuppan (1980) and *Gosei Kobunshi V*, pp. 187–286, Asakura Shoten (1971).

These polyesters preferably have a weight average molecular weight of from about 10,000 to 500,000.

In order to improve adhesion to polyesters of different kind, part of the above-described polyesters may be replaced with other polyesters, or the above-described polyesters may further comprise a comonomer which constitutes the other polyester, or the above-described polyester and the other polyester may both comprise a monomer having an unsaturated bond so as to form a radical-crosslinked structure.

A polymer blend comprising two or more of the resulting polyesters can easily be molded according to the method described in JP-A-49-5482 (the term "JP-A" as used herein means an "unexamined published Japanese patent application"), JP-A-64-4325, JP-A-3-192718, *Research Disclosure* 283739-41, ibid 284779-82, and ibid 294807-14.

The terminology "glass transition point (Tg)" as used herein is defined as a mean value of a temperature at which a differential thermogram of a sample in a differential thermal analysis begins to deviate from a base line and a temperature at which the differential thermogram returns to a new base line, the differential thermal analysis being conducted by heating a sample film weighing 10 mg in a helium-nitrogen stream at a temperature increase rate of 20° C./min by means of a differential scanning calorimeter (DSC). When an endothermic peak appears, the temperature showing the maximum of the endothermic peak is taken as a Tg.

The polyester to be used in the present invention should have a Tg of 50° C. or higher. In general, photographic materials for photographing are not always handled with care, and it is very likely that they are exposed to severe conditions, e.g., outdoor temperatures as high as 40° C. in the summer. From this viewpoint, the Tg of the polyester is desirably 55° C. or higher. Further, while a polyester support is endowed with improved recovery from curl by a heat treatment as hereinafter described, the support loses the improved recovery upon being exposed to a temperature exceeding its glass transition point. From this viewpoint, the Tg of the polyester is preferably 60° C. or higher, and still preferably 70° C. or higher.

On the other hand, the upper limit of the Tg is 200° C. Polyesters whose Tg exceeds 200° C. do not provide highly transparent films. Accordingly, the polyester which can be used in the present invention should have a Tg between 50° and 200° C.

Specific but non-limiting examples of the polyesters which can be used in the present invention for preference are shown below. A ratio in parentheses is a molar ratio.

P-0: [Terephthalic acid (TPA)/ethylene glycol (EG)) (100/100)] (PET); Tg=80° C.

P-1: [2,6-Naphthalenedicarboxylic acid (NDCA)/ethylene glycol (EG) (100/100)] (PEN); Tg=119° C.

P-2: [TPA/cyclohexanedimethanol (CHDM) (100/100)]; Tg=93° C.

P-3: [TPA/bisphenol A (BPA) (100/100)](PAr); Tg=192° C.

P-4: 2,6-NDCA/TPA/EG (50/50/100); Tg=92° C.

P-5: 2,6-NDCA/TPA/EG (75/25/100); Tg=102° C.

P-6: 2,6-NDCA/TPA/EG/BPA (50/50/75/25); Tg=112° C.

P-7: TPA/EG/BPA (100/50/50); Tg=105° C.

P-8: TPA/EG/BPA (100/25/75); Tg=135° C.

P-9: TPA/EG/CHDM/BPA (100/25/25/50); Tg=115° C.

P-10: [Isophthalic acid (IPA)/biphenyl-4,4'-dicarboxylic acid (PPDC)/TPA/EG (20/50/30/100)]; Tg=95° C.

P-11: [NDCA/neopentyl glycol (NPG)/EG (100/70/30)]; Tg=105° C.

P-12: TPA/EG/BP (100/20/80); Tg=115° C.

P-13: [p-Hydroxybenzoic acid (PHBA)/EG/TPA (200/100/100); Tg=125° C.

P-14: PEN/PET (60/40); Tg=95° C.

P-15: PEN/PET (80/20); Tg=104° C.

P-16: PAr/PEN (50/50); Tg=142° C.

P-17: PAr/PCT (50/50); Tg=118° C.

P-18: PAr/PET (60/40); Tg=101° C.

P-19: PEN/PET/PAr (50/25/25); Tg=108° C.

P-20: TPA/5-sulfoisophthalic acid (SIP)/EG (95/5/100); Tg=65° C.

The polyester support (film base) preferably has a thickness of from 50 to 100 μm. A thickness less than 50 μm fails to withstand the stress of shrinkage of a light-sensitive layer on drying. A support whose thickness exceeds 100 μm makes a roll of the photographic material bulky, conflicting the demand for compactness, but is usable for sheet materials. The upper limit of the support thickness for sheet materials is 300 μm.

All the above-mentioned polyesters have a higher flexural modulus of elasticity than TAC, which makes it possible to reduce a film thickness. In particular, PET and PEN having a higher flexural modulus of elasticity than other polyesters make it possible to reduce a thickness of 120 μm, which was required in using TAC, to 100 μm or even less. A suitable thickness of a PET or PEN film is 80 to 90 μm.

The polyester support according to the present invention is characterized by being subjected to a heat treatment at a temperature not lower than 40° C. and lower than the glass transition point for a period of from 0.1 to 1500 hours. The higher the treating temperature, the faster the effects appear. If the treating temperature exceeds the Tg, the molecules in the film move rather disorderly to have an increased free volume. As a result, the molecules become so fluid that curl is easily set. This is the reason why the heating temperature should be lower than the Tg.

For reduction of a treating time, the heat treating temperature is preferably slightly lower than the Tg. Specifically, the heat treating temperature is to fall between 40° C. and a temperature below the Tg, preferably between a temperature lower than the Tg by 30° C. and a temperature below the Tg.

The effect of the heat treatment begins to be manifested after 0.1 hour's treatment and almost reaches saturation on and after 1500 hours' treatment. Accordingly, the heat treatment is preferably conducted for 0.1 to 1500 hours.

The treating time may further be reduced by preheating a polyester support to a temperature above the Tg for a short time (preferably at a temperature higher than the Tg by 20° to 100° C. for 5 minutes to 3 hours) followed by cooling to a temperature below the Tg and not lower than 40° C., at which the polyester support is treated. The heat treatment may be carried out by leaving film rolls to stand in a hot warehouse or carrying the film rolls through a hot zone. The latter manner is preferred for production suitability. It is preferable for efficient heat conduction that the mandrel around which the film is rolled during the heat treatment has a hollow structure or a structure containing therein an electric heater or such a structure that a high temperature fluid is passed therethrough. While not limiting, the mandrel is preferably made of materials suffering no reduction in strength or deformation on heating, such as stainless steel or glass fiber-reinforced resins.

The polyester according to the present invention preferably contains various additives so as to have improved functions as a support of photographic materials.

For example, an ultraviolet absorbent can be incorporated into a polyester film for prevention of fluorescence and for stabilization against time. Ultraviolet absorbents having no absorption in the visible light are preferred. It is added in an amount usually of 0.01 to 20% by weight, preferably 0.05 to 10% by weight, based on the weight of a polyester film. If the amount is less than 0.01% by weight, no effect on inhibition of UV deterioration is expected.

Suitable UV absorbents include benzophenone compounds, e.g., 2,4-dihydroxybenzophenone, 2-hydroxy-4-methoxybenzophenone, 2-hydroxy-4-n-octoxybenzophenone, 4-dodecyloxy-2-hydroxybenzophenone, 2,2',4,4'-tetrahydroxybenzophenone, and 2,2'-dihydroxy-4,4'-dimethoxybenzophenone; benzotriazole compounds, e.g., 2-(2'-hydroxy-5-methylphenyl)benzotriazole, 2-(2'-hydroxy-3',5'-di-t-butylphenyl)benzotriazole, and 2-(2'-hydroxy-3'-di-t-butyl-5'-methylphenyl)benzotriazole; salicylic acid derivatives, e.g., phenyl salicylate and methyl salicylate; and triazine compounds, e.g., 2,4,6-tris[2'-hydroxy-4'-(2"-ethylhexyloxy)phenyl]triazine and 2-phenyl-4,6-di[2'-hydroxy-4'-(2"-ethylhexyloxy)phenyltriazine.

Another problem associated with the use of the polyester film of the present invention as a support of photographic materials is edge fog due to the high refractive index of the support.

The polyester of the present invention, especially an aromatic polyester has a refractive index as high as 1.6 to 1.7 as compared with that of gelatin (1.50 to 1.55) which is a main component of light-sensitive emulsion layers. As a result, when light enters from a film edge, it is apt to be reflected on the interface between the support and the emulsion layer, causing so-called a light piping phenomenon (edge fog).

It is known to incorporate inert inorganic particles or dyes to a polyester film for the purpose of avoiding such a light piping phenomenon.

In the present invention, the light piping phenomenon is preferably avoided by addition of a dye that does not cause a remarkable increase in film haze. Dyes which can be used for film dyeing are, while not limiting, preferably gray dyes from considerations of general properties of photographic materials. Further, the dyes to be used preferably have excellent heat resistance in a temperature range for film formation and excellent compatibility with polyesters. From these viewpoints, an appropriate mixture of commercially available dyes for polyesters, e.g., "DIARESIN" produced by Mitsubishi Chemical Industries Ltd. and "KAYASET" produced by Nippon Kayaku Co., Ltd., can be employed to achieve the purpose.

The color density of dyeing should be at least 0.01, and preferably 0.03 or higher, as measured in the visible region with a Macbeth densitometer.

The polyester film may also be provided with lubricity depending on the use. While not limiting, lubricity can generally be imparted by addition of particles of an inert inorganic compound or application of a surface active agent.

Examples of suitable inert inorganic compound particles for imparting lubricity include $SiO_2$, $TiO_2$, $BaSO_4$, $CaCO_3$, talc, and kaolin. Instead of externally adding particles inert to the polyester synthesis reaction system, particles for imparting lubricity may be internally supplied as a result of precipitation of, for example, a catalyst used in the synthesis of a polyester.

Since transparency is of great importance for a support of photographic materials, it is preferable to use, as an external additive, $SiO_2$ whose refractive index is relatively close to that of a polyester film or to choose such an internal particle system in which the size of the particles precipitated may be relatively reduced.

Where lubricity is provided by addition of inorganic particles, transparency of the polyester film will be assured by laminating a functional layer by, for example, coextrusion by means of a plurality of extruders, and a feed block, or a multi-manifold die.

Because these polymer films all have a hydrophobic surface, it is very difficult to form a photographic layer comprising a protective colloid mainly comprising gelatin, such as a light-sensitive silver halide emulsion layer, an intermediate layer or a filter layer, thereon with strong adhesion. Means for overcoming this difficulty include (1) a surface activation treatment, such as a chemical treatment, a mechanical treatment, a corona discharge treatment, a flame treatment, a UV treatment, an RF treatment, a glow discharge treatment, an active plasma treatment, a laser treatment, a mixed acid treatment, an ozone treatment, and the like (a photographic emulsion is directly applied on the thus treated surface) and (2) formation of a subbing layer on a polymer film either as untreated or treated by the above-described surface treatment (a photographic emulsion is then applied on the thus formed subbing layer). The details about a subbing layer are described in U.S. Pat. Nos. 2,698,241, 2,764,520, 2,864,755, 3,462,335, 3,475,193, 3,143,421, 3,501,301, 3,460,944, and 3,674,531, British Patents 788, 365, 804,005, and 891,469, JP-B-48-43122, and JP-B-51-446.

These surface treatments seem to introduce more or less polar groups to the essentially hydrophobic surface of a polymer film and/or to increase the crosslinking density of the polymer surface. The results possibly obtained from the surface treatments include increased affinity between the support and the polar groups of a component contained in a subbing layer and increased strength of the treated surface.

Various manipulations have been added also to the structure of a subbing layer. For example, a double layer method, in which a first layer having good adhesion to a support (hereinafter referred to as a first subbing layer) is provided on a support and then a second layer comprising a hydrophilic resin showing good contact with a photographic layer (hereinafter referred to as a second subbing layer) is provided thereon, and a single layer method, in which a single resin layer containing both a hydrophobic group and a hydrophilic group is provided on a support, have been proposed.

Of the above-described surface treatments (1), a corona discharge treatment is the most well-known technique. A corona discharge treatment can be carried out by any of known methods described, e.g., in JP-B-48-5043, JP-B-47-51905, JP-A-47-20867, JP-A-49-83767, JP-A-51-41770, and JP-A-51-131576. The discharge frequency suitably ranges from 50 to 5000 kHz, preferably from 5 kHz to several hundred kHz. If the frequency is too low, a stable discharge cannot be obtained, and the treated object tends to suffer from pinholes. If the frequency is too high, a special device for impedance matching would be needed, increasing the equipment cost. For improvement of wetting properties of a general plastic film, such as a polyester film or a polyolefin film, the treatment intensity is suitably from 0.001 $kV \cdot A \cdot min/m^2$ to 5 $kV \cdot A \cdot min/m^2$, preferably from 0.01 $kV \cdot A \cdot min/m^2$ to 1 $kV \cdot A \cdot min/m^2$. The gap clearance between an electrode and a dielectric roll is 0.5 to 2.5 mm, preferably 1.0 to 2.0 mm.

A glow discharge treatment, which is the most effective in many cases, can be carried out by any of known methods described, e.g., in JP-B-35-7578, JP-B-36-10336, JP-B-45-22004, JP-B-45-22005, JP-B-45-24040, JP-B-46-43480, U.S. Pat. Nos. 3,057,792, 3,057,795, 3,179,482, 3,288,638, 3,309,299, 3,424,735, 3,462,335, 3,475,307, and 3,761,299, British Patent 997,093, and JP-A-53-129262.

The glow discharge treatment is usually conducted under reduced pressure of 0.005 to 20 Torr, preferably 0.02 to 2 Torr. Under too low pressure, the surface treating effect is lessened. If the pressure is too high, an excessive current passes to emit sparks, which are not only dangerous but may destroy the treated object. A glow discharge occurs by applying a high voltage to one or more pairs of metal plates or metal rods placed in a vacuum tank with a space therebetween. While the voltage to be applied is subject to variation depending on the composition of the surrounding gas or the pressure, a stationary glow discharge occurs under the above-mentioned pressure condition at a voltage of from 500 to 5000 V. For improvement of adhesion, a particularly suitable voltage ranges from 2000 to 4000 V.

The discharge frequency suitably ranges from a direct current to several thousand MHz, preferably from 50 Hz to 20 MHz, as usual with conventional techniques. A suitable treatment intensity for obtaining desired adhesion performance is from 0.01 to 5 kV·A·min/$m^2$, preferably from 0.15 to 1 kV·A·min/$m^2$.

The method (2) of providing a subbing layer has been given much study. For example, with respect to the double layer method, many polymers have been studied for their suitability as a material of a first subbing layer, including copolymers comprising a monomer selected from vinyl chloride, vinylidene chloride, butadiene, methacrylic acid, acrylic acid, itaconic acid, maleic anhydride, etc., polyesterimine, epoxy resins, grafted gelatin, and nitrocellulose, and the characteristics of gelatin have been studied as a main component of a second subbing layer.

In the case of the single layer method, satisfactory adhesion is obtained usually by swelling a support to make it be mixed with a hydrophilic polymer which can be used as a subbing layer at the interface.

The hydrophilic polymer which can be used in the present invention as a subbing layer includes water-soluble polymers, cellulose esters, latex polymers, and water-soluble polyesters. Examples of the water-soluble polymers are gelatin, gelatin derivatives, casein, agar, sodium alginate, starch, polyvinyl alcohol, polyacrylic acid copolymers, and maleic anhydride copolymers. Examples of the cellulose esters are carboxymethyl cellulose and hydroxyethyl cellulose. Examples of the latex polymers are vinyl chloride copolymers, vinylidene chloride copolymers, acrylic ester copolymers, vinyl acetate copolymers, and butadiene copolymers. The most preferred of them is gelatin.

A compound which can be used in the single subbing layer for swelling a support includes resorcin, chlororesorcin, methylresorcin, o-cresol, m-cresol, p-cresol, phenol, o-chlorophenol, p-chlorophenol, dichlorophenol, trichlorophenol, monochloroacetic acid, dichloroacetic acid, trifluoroacetic acid, and hydrated chloral, with resorcin and p-chlorophenol being preferred.

The subbing layer may contain various known gelatin hardening agents. Examples of suitable gelatin hardening agents include chromium salts (e.g., chromium alum), aldehyde compounds (e.g., formaldehyde and glutaraldehyde), isocyanate compounds, epichlorohydrin resins, cyanuric chloride compounds (e.g., the compounds described in JP-B-47-6151, JP-B-47-33380, JP-B-54-25411, and JP-A-56-130740), vinylsulfone or sulfonyl compounds (e.g., the compound described in JP-B-47-24259, JP-B-50-35807, JP-A-49-24435, JP-A-53-41221, and JP-A-59-18944), carbamoyl ammonium salt compounds (e.g., the compounds described in JP-B-56-12853, JP-B-58-32699, JP-A-49-51945, JP-A-51-59625, JP-A-61-9641), amidinium compounds (e.g., the compounds disclosed in JP-A-60-225148), carbodiimide compounds (e.g., the compounds disclosed in JP-A-51-126125 and JP-A-52-48311), pyridinium salt compounds (e.g., the compounds described in JP-B-58-50699, JP-A-52-54427, JP-A-57-44140, and JP-A-57-46538), and the compounds disclosed in Belgian Patent 825,726, U.S. Pat. No. 3,321,313, JP-A-50-38540, JP-A-52-93470, JP-A-56-43353, and JP-A-58-113929.

The subbing layer may further contain fine particles of organic or inorganic substances as a matting agent in such a proportion that does not substantially impair the transparency or graininess of an image. Inorganic matting agents include silica ($SiO_2$), titanium dioxide ($TiO_2$), calcium carbonate, and magnesium carbonate. Organic matting agents include polymethyl methacrylate, cellulose acetate propionate, polystyrene, those disclosed in U.S. Pat. No. 4,142,894 which are soluble in a processing solution, and polymers disclosed in U.S. Pat. No. 4,396,706. These matting agents preferably have an average particle size of 1 to 10 μm.

If desired, the subbing layer can furthermore contain various additives, such as surface active agents, antistatic agents, antihalation agents, dyes, pigments, coating aids, and antifoggants. Where a double-layered subbing layer is to be formed in the present invention, the coating composition for a first subbing layer does not need to contain an etching agent, such as resorcin, hydrated chloral or chlorophenol. It is a matter of course, that the coating composition may contain such an etching agent if desired.

The subbing layer can be formed by a well-known coating method, such as dip coating, air knife coating, curtain coating, roller coating, wire bar coating, gravure coating, and extrusion coating using the hopper described in U.S. Pat. No. 2,681,294. If desired, two or more layers may be formed simultaneously by known methods, such as the methods described in U.S. Pat. Nos. 2,761,791, 3,508,947, 2,941,898, and 3,526,528, and Yuji Harasaki, *Coating Kogaku*, p. 253, Asakura Shoten (1973).

The binder of a backing layer may be either hydrophobic polymers or such hydrophilic polymers as used in the subbing layer.

The backing layer may contain antistatic agents, lubricants, matting agents, surface active agents, dyes, and the like.

The antistatic agents which can be incorporated into the backing layer are not particularly limited and include, for example, anionic polyelectrolytes containing a carboxylic acid or a salt thereof or a sulfonic acid salt, such as those disclosed in JP-A-48-22017, JP-B-46-24159, JP-A-51-30725, JP-A-51-129216, and JP-A-55-95942; and cationic high polymers, such as those described in JP-A-49-121523, JP-A-48-91165, and JP-B-49-24582. The surface active agents which can be used in the backing layer include anionic surface active agents and cationic surface active agents, such as those described in JP-A-49-85826, JP-A-49-33630, U.S. Pat. Nos. 2,992,108, 3,206,312, JP-A-48-87826, JP-B-49-11567, JP-B-49-11568, and JP-A-55-70837.

The most preferred antistatic agents to be used in the backing layer of the present invention are fine particles of at least one crystalline metal oxide selected from ZnO, $TiO_2$, $SnO_2$, $Al_2O_3$, $In_2O_3$, $SiO_2$, MgO, BaO, $MoO_3$, and $V_2O_5$, or a complex oxide of these metallic atoms.

These conductive particles of crystalline metal oxides or complex oxides have a volume resistivity of not more than $10^7$ Ωcm, preferably not more than $10^5$ Ωcm. A preferred particle size of these oxide particles is from 0.002 to 0.7 μm, and particularly from 0.005 to 0.3 μm.

The silver halide color photographic material according to the present invention may have a magnetic recording layer for recording various kinds of information. Known ferromagnetic substances may be used. The magnetic recording layer is preferably provided on the back side of a support. The magnetic recording layer can be formed by coating or printing. The photographic material may also have a space in which various kinds of information can be recorded by an optical technique.

The central hollow part or a spool, if used, of the roll film in a camera is preferably made as small as possible, but if it is too small as having a diameter less than 3 mm, the photographic material undergoes the influence of the pressure to deteriorate its photographic performance. Accordingly, the diameter of the central hollow part or spool of the roll film in a camera is from 3 to 12 mm, preferably 3 to 10 mm, still preferably 4 to 9 mm.

Similarly, the diameter of the film rolled around a spool is preferably as small as possible. However, if the diameter is less than 5 mm, the photographic material undergoes the influence of the pressure to deteriorate its photographic performance, and the number of frames loaded should be reduced. Accordingly, the diameter of the film rolled around a spool is suitably 5 to 15 mm, preferably 6 to 13.5 mm, still preferably 7 to 13.5 mm, and particularly preferably 7 to 13 mm.

With respect to the other techniques and organic or inorganic materials which can be applied to the color photographic material of the present invention, reference can be made in EP-A-436938 at pages and lines shown below and also in the patents shown below.

1. Layer structure: p. 146, l. 34 to p. 147, l. 25
2. Silver halide emulsions: p. 147, l. 26 to p. 148, l. 12
3. Yellow couplers: p. 137, l. 35 to p. 146, l. 33, p. 149, ll. 21–23
4. Magenta couplers: p. 149, ll. 24–28; EP-A-421453, p. 3, 1.5 to p. 25, 1.55
5. Polymer couplers: p. 149, ll. 34–38; EP-A-435334, p. 113, 1.39 to p. 123, 1.37
6. Colored couplers: p. 53, l. 42 to p. 137, l. 34, p. 149, ll. 39–45
7. Other functional couplers: p. 7, l. 1 to p. 53, l. 41, p. 149, 1.46 to p. 150, 1.3; EP-A-435334, p. 3, l. 1 to p 29, l. 50
8. Antiseptics and antifungals: p. 150, ll. 25–28
9. Formalin scavengers: p. 149, ll. 15–17
10. Other additives: p. 153, ll. 38–47; EP-A-421453, p. 75, l. 21 to p. 84, l. 56, p. 27, l. 40 to p. 37, l. 40
11. Method of dispersing: p. 150, ll. 4–24
12. Film thickness and film properties: p. 150, ll. 35–49
13. Color development: p. 150, l. 50 to p. 151, l. 47
14. Desilvering: p. 151, l. 48 to p. 152, l. 53
15. Automatic developing machine: p. 152, l. 54 to p. 153, ll.
6. Washing and stabilization: p. 153, ll. 3–37

The present invention will now be illustrated in greater detail with reference to Examples, but the present invention should not be construed as being limited thereto.

EXAMPLE 1

(1) Materials of Support:

Supports used in this Example were prepared by the following methods.

PEN:

A mixture of 100 parts by weight of a commercially available polyethylene-2,6-naphthalate polymer and 2 parts by weight of a UV absorbent TINUVIN P. 326 (produced by Ciba-Gergy Ltd.) was dried in a conventional manner, melt-kneaded at 300° C., and extruded from a T-die. The extruded film was stretched first at 140° C. at a stretch ratio of 3.3 in the machine direction and then at 130° C. at a stretch ratio of 3.3 in the transverse direction, followed by heat setting at 250° C. for 6 seconds.

PET:

A commercially available polyethylene terephthalate polymer was biaxially stretched and heat set in a conventional manner to obtain a 90 μm thick film.

TAC:

A triacetyl cellulose film was obtained by bandcasting process using a casting solution of 13% by weight of triacetyl cellulose and 15% by weight of a plasticizer (triphenyl phosphate(TPP)/biphenyldiphenyl phosphate (BDP)=2/1) in methylene chloride/methanol (82/8 by weight).

PEN/PET (4/1 by weight):

PEN pellets and PET pellets, having been dried previously at 150° C. in vacuo for 4 hours, were melt-extruded from a twin-screw extruder at 280° C., and pelletized. A stretched polyester film was obtained from the resulting pellets in the same manner as for PEN.

(2) Formation of Subbing Layer:

After both sides of each support were subjected to a corona discharge treatment, a coating composition having the following formulation was applied to the side which had a higher temperature than the other side at the time of stretching to thereby form a subbing layer. The corona discharge treatment was carried out by the use of a solid state corona treating machine 6KVA Model, manufactured by Pillar Inc., at a speed of 20 m (×30 cm width)/min to a treating intensity of 0.375 kV·A·min/$m^2$ as calculated from the current and voltage readings. The discharge frequency was 9.6 kHz, and the gap clearance between the electrode and the dielectric roll was 1.6 mm.

Formulation of Coating Composition for Subbing Layer:

Gelatin 3 g
Distilled water 250 cc
Sodium α-sulfodi-2-ethylhexylsuccinate 0.05 g
Salicylic acid 0.1 g
Methanol 15 cc
Acetone 85 cc
Formaldehyde 0.01 g (3) Formation of Backing Layer:

A backing layer having the composition shown below was formed on the support on the side opposite to the subbing layer.

(3-1) Preparation of Dispersion of Conductive Particles (Dispersion of Tin Oxide doped with Antimony Oxide):

In 3000 parts by weight of ethanol were uniformly dissolved 230 parts by weight of stannic chloride hydrate and 23 parts by weight of antimony trichloride, and a 1N sodium hydroxide aqueous solution was added dropwise to the solution until the solution was adjusted to pH 3 to obtain a colloidal co-precipitate of stannic oxide and antimony oxide. The co-precipitate was allowed to stand at 50° C. for 24 hours to obtain a reddish brown colloidal solid.

The reddish brown colloidal precipitate was recovered by centrifugal separation and washed with water by centrifugation to remove excess ions. Centrifugal washing was repeated three times for removal of excess ions.

In 1500 parts by weight of water was dispersed 200 parts by weight of the colloidal precipitate from which excess ions had been removed, and the dispersion was atomized in a calcining furnace heated at 600° C. to obtain bluish fine particles of tin oxide doped with antimony oxide having an average particle size of 0.1 μm. The fine particles had a specific resistivity of 25 Ω·cm.

A mixture of 40 parts by weight of the above obtained fine particles and 60 parts by weight of water was adjusted to pH 7.0, coarsely dispersed in a stirrer, and then finely dispersed in a horizontal sand mill, DYNOMILL, manufactured by WILLYA. BACHOFENAG, to a retention time of 30 minutes.

(3-2) Formation of Backing Layer:

A coating composition having formulation (A) shown below was applied to a dry thickness of 0.3 μm and dried at 115° C. for 60 seconds. A coating composition having formulation (B) shown below was then applied thereon to a dry thickness of 1 μm and dried at 115° C. for 3 minutes.

Formulation (A):

Above-described dispersion of conductive particles 10 parts by wt.
Gelatin 1 part by wt.
Water 27 parts by wt.
Methanol 60 parts by wt.
Resorcin 2 parts by wt.
Polyoxyethylene nonylphenyl ether 0.01 part by wt.

Formulation (B):

Cellulose triacetate 1 part by wt.
Acetone 70 parts by wt.
Methanol 15 parts by wt.
Dichloromethylene 10 parts by wt.
p-Chlorophenol 4 parts by wt.
Silica particles (average size: 0.2 μm) 0.01 part by wt.
Polysiloxane 0.005 part by wt.
$C_{15}H_{31}COOC_{40}H_{81}/C_{50}H_{101}O(CH_2CH_2O)_{16}H$ 0.01 part by wt.
(8/2 by weight) dispersion (average particle size: 20 nm)

(4) Heat Treatment of Support:

The support having provided thereon a subbing layer and a backing layer was wound around a mandrel (diameter: 30 cm) with the subbing layer outside and subjected to a heat treatment under conditions shown in Table 3. Supports PEN, PET, and PEN/PET (4/1 by weight) which were not heat-treated were also prepared.

(5) Formation of Light-Sensitive Layers:

The following layers were successively formed on each support to obtain a multi-layer color photographic material.

Composition of Light-Sensitive Layers:

Main materials used in the following layers are classified as follows.

ExC: Cyan coupler
ExM: Magenta coupler
ExY: Yellow coupler
ExS: Sensitizing dye
UV: Ultraviolet absorbent
HBS: High-boiling organic solvent
H: Gelatin hardening agent The numerals added to each component are the spread in terms of gram per square meter. The spread of silver halide emulsions is expressed in terms of gram of silver per square meter (g-Ag/$m^2$), and the spread of sensitizing dyes is expressed in terms of molar unit per mole of the silver halide of the same layer (mol/mol-AgX).

Layer Structure of Sample 101:

First Layer (Antihalation Layer):

Black colloidal silver Ag 0.09
Gelatin 1.60
ExM-1 0.12
ExF-1 $2.0\times10\times10^{-3}$
Solid disperse dye ExF-2 0.030
Solid disperse dye ExF-3 0.040
HBS-1 0.15
HBS-2 0.02

Second Layer (Intermediate Layer):

Silver iodobromide emulsion M Ag 0.065
ExC-2 0.04
Polyethyl acrylate latex 0.20
Gelatin 1.04

Third Layer (Low Sensitivity Red-Sensitive Emulsion Layer):

Silver iodobromide emulsion A Ag 0.25
Silver iodobromide emulsion B Ag 0.25
ExS-1 $6.9\times10^{-5}$
ExS-2 $1.8\times10^{-5}$
ExS-3 $3.1\times10^{-4}$
ExC-1 0.17
ExC-3 0.030
ExC-4 0.10
ExC-5 0.020
ExC-6 0.010
HBS-1 0.10
Gelatin 0.87

Fourth Layer (Middle Sensitivity Red-Sensitive Emulsion Layer):

Silver iodobromide emulsion C Ag 0.70
ExS-1 $3.5\times10^{-4}$
ExS-2 $1.6\times10^{-5}$
ExS-3 $5.1\times10^{-4}$
ExC-1 0.13
ExC-2 0.060
ExC-3 0.0070
ExC-4 0.090
ExC-5 0.015
ExC-6 0.0070
Cpd-2 0.023
HBS-1 0.10
Gelatin 0.75

Fifth Layer (High Sensitivity Red-Sensitive Emulsion Layer):

Silver iodobromide emulsion D Ag 1.40
ExS-1 $2.4\times10^{-4}$
ExS-2 $1.0\times10^{-4}$
ExS-3 $3.4\times10^{-4}$
ExC-1 0.10
ExC-3 0.045
ExC-6 0.020
ExC-7 0.010
HBS-1 0.22
HBS-2 0.050
Gelatin 1.10

Sixth Layer (Intermediate Layer):

Cpd-1 0.090
Solid disperse dye ExF-4 0.030
HBS-1 0.050
Polyethyl acrylate latex 0.15
Gelatin 1.10

Seventh Layer (Low Sensitivity Green-Sensitive Emulsion Layer):

Silver iodobromide emulsion E Ag 0.15
Silver iodobromide emulsion F Ag 0.10
Silver iodobromide emulsion G Ag 0.10
ExS-4 $3.0\times10^{-5}$
ExS-5 $2.1\times10^{-4}$
ExS-6 $8.0\times10^{-4}$
ExM-2 0.33
ExM-3 0.086
ExY-1 0.015
HBS-1 0.30
HBS-3 0.010
Gelatin 0.73

Eighth Layer (Middle Sensitivity Green-Sensitive Emulsion Layer):

Silver iodobromide emulsion H Ag 0.80
ExS-4 $3.2\times10^{-5}$
ExS-5 $2.2\times10^{-4}$
ExS-6 $8.4\times10^{-4}$
ExC-8 0.010
ExM-2 0.10
ExM-3 0.025
ExY-1 0.018
ExY-4 0.010
ExY-5 0.040
HBS-1 0.13
HBS-3 $4.0\times10^{-3}$
Gelatin 0.80

Ninth Layer (High Sensitivity Green-Sensitive Emulsion Layer):

Silver iodobromide emulsion I Ag 1.25
ExS-4 $3.7\times10^{-5}$
ExS-5 $8.1\times10^{-5}$
ExS-6 $3.2\times10^{-4}$
ExC-1 0.010
ExM-1 0.020
ExM-4 0.025
ExM-5 0.040
Cpd-2 0.040
HBS-1 0.25
Polyethyl acrylate latex 0.15
Gelatin 1.33

Tenth Layer (Yellow Filter Layer):

Yellow colloidal silver Ag 0.015
Cpd-1 0.16
Solid disperse dye ExF-5 0.060
Solid disperse dye ExF-6 0.060
Oil-soluble dye ExF-7 0.010
HBS-1 0.60
Gelatin 0.60

Eleventh Layer (Low Sensitivity Blue-Sensitive Emulsion Layer):

Silver iodobromide emulsion J Ag 0.09
Silver iodobromide emulsion K Ag 0.09
ExS-7 $8.6\times10^{-4}$
ExC-8 $7.0\times10^{-3}$
ExY-1 0.050
ExY-2 0.22
ExY-3 0.50
ExY-4 0.020
Cpd-2 $4.0\times10^{-3}$
HBS-1 0.28
Gelatin 1.20

Twelfth Layer (High Sensitivity Blue-Sensitive Emulsion Layer):

Silver iodobromide emulsion L Ag 1.00
ExS-7 $4.0\times10^{-4}$
ExY-2 0.10
ExY-3 0.10
ExY-4 0.010
Cpd-2 $1.0\times10^{-3}$
HBS-1 0.070
Gelatin 0.70

Thirteenth Layer (1st Protective Layer):

UV-1 0.19
UV-2 0.075
UV-3 0.065
HBS-1 $5.0\times10^{-2}$
HBS-4 $5.0\times10^{-2}$
Gelatin 1.8

Fourteenth Layer(2nd Protective Layer):

Silver iodobromide emulsion M Ag 0.10
H-1 0.40
B-1 (diameter: 1.7 μm) $5.0\times10^{-2}$
B-2 (diameter: 1.7 μm) 0.15
B-3 0.05
S-1 0.20
Gelatin 0.70

For the purpose of improving preservability, processability, pressure resistance, antifungal and antibacterial activity, antistatic properties, and coating properties, each layer further contained W-1 to W-3, B-4 to B-6, F-1 to F-15, an iron salt, a lead salt, a gold salt, a platinum salt, a palladium salt, an iridium salt or a rhodium salt.

TABLE 2

| Emulsion No. | Average AgI Content (%) | Coefficient of Variation of AgI Content Among Grains (%) | Average Grain Size (sphere-equivalent diameter) (μm) | Coefficient of Variation of Grain Size (%) | Projected Area Circle-equiv. Diameter *μm) | Diameter/ Thickness Ratio |
|---|---|---|---|---|---|---|
| A | 1.7 | 10 | 0.46 | 15 | 0.56 | 5.5 |
| B | 3.5 | 15 | 0.57 | 20 | 0.78 | 4.0 |
| C | 8.9 | 25 | 0.66 | 25 | 0.87 | 5.8 |
| D | 8.9 | 18 | 0.84 | 26 | 1.03 | 3.7 |
| E | 1.7 | 10 | 0.46 | 15 | 0.56 | 5.5 |
| F | 3.5 | 15 | 0.57 | 20 | 0.78 | 4.0 |
| G | 8.8 | 25 | 0.61 | 23 | 0.77 | 4.4 |
| H | 8.8 | 25 | 0.61 | 23 | 0.77 | 4.4 |
| I | 8.9 | 18 | 0.84 | 26 | 1.03 | 3.7 |
| J | 1.7 | 10 | 0.46 | 15 | 0.50 | 4.2 |
| K | 8.8 | 18 | 0.64 | 23 | 0.85 | 5.2 |
| L | 14.0 | 25 | 1.28 | 26 | 1.46 | 3.5 |
| M | 1.0 | — | 0.07 | 15 | — | 1 |

In Table 2, (1) emulsions J to L had been sensitized during grain formation by reduction sensitization using thiourea dioxide and thiosulfonic acid in accordance with Example of JP-A-2-191938 (corresponding to U.S. Pat. No. 5,061,614); (2) emulsions A to I had been sensitized by gold sensitization, sulfur sensitization and selenium sensitization in the presence of the respective spectral sensitizing dyes as described for the respective light-sensitive layer and sodium thiocyanate in accordance with Example of JP-A-3-237450 (corresponding to EP-A-443453); (3) tabular silver halide grains were prepared by using low-molecular weight gelatin according to Example of JP-A-1-158426; (4) tabular grains were observed to have a dislocation line as described in JP-A-3-237450 under a high-voltage electron microscope; and (5) emulsion L comprised double-layered grains having a high iodide content in the core thereof as described in JP-A-60-143331.

Preparation of Dispersion of Organic Solid Disperse Dye:

Organic solid disperse dye ExF-2 was dispersed by the following method. In a 700 ml pot mill were charged 21.7 ml of water, 3 ml of a 5% aqueous solution of sodium p-octylphenoxyethoxyethoxyethanesulfonate, and 0.5 g of a 5% aqueous solution of p-octylphenoxypolyoxyethylene ether (degree of polymerization: 10). After 5.0 g of organic solid disperse dye ExF-2 and 500 ml of zirconium oxide beads (diameter: 1 mm) were added thereto, the mixture was dispersed for 2 hours by means of a BO type vibration ball mill manufactured by Chuo Koki K.K. The dispersion was taken out of the ball mill, added to 8 g of a 12.5% gelatin aqueous solution, and filtered to remove the beads to obtain a gelatin dispersion of the dye. The dispersed dye particles had an average particle size of 0.44 μm.

Dispersions of solid disperse dye ExF-3, ExF-4 or ExF-6 were prepared in the same manner. The dispersed particle size was 0.24 μm, 0.45 μm, or 0.52 μm, respectively. A dispersion of solid disperse dye ExF-5 was prepared by the microprecipitation dispersion method described in Example 1 of EP-A-549489. The average dispersed particle size was 0.06 μm.

ExC-1

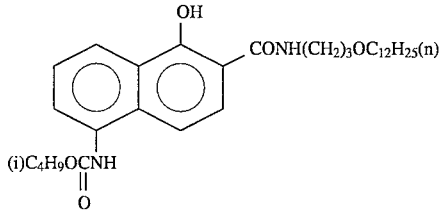

ExC-2

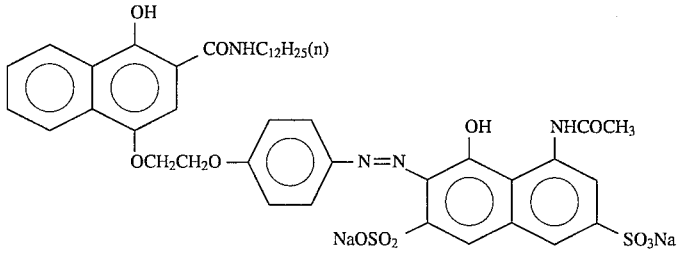

ExC-3

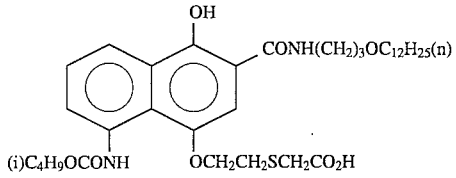

ExC-4

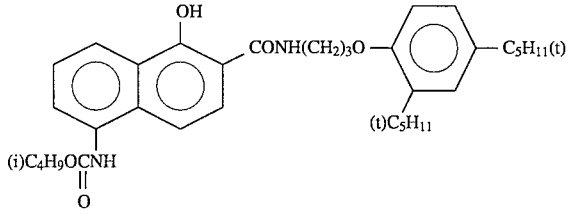

-continued
ExC-5
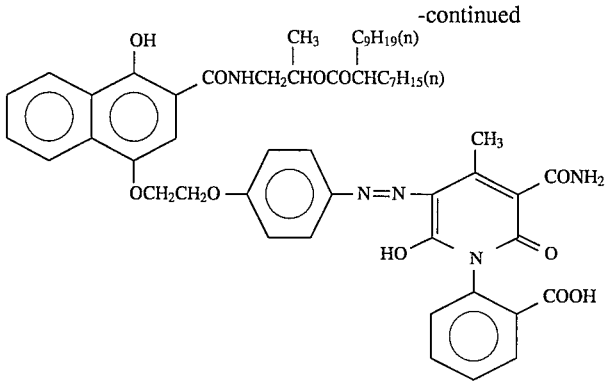
ExC-6
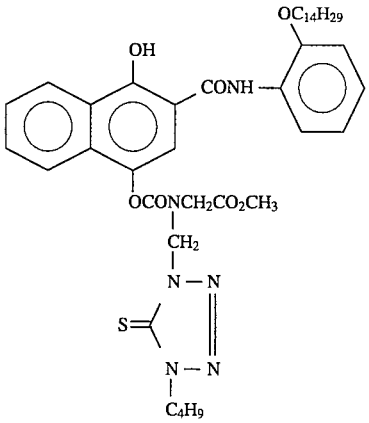
ExC-7
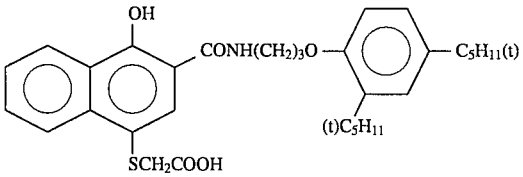
ExC-8
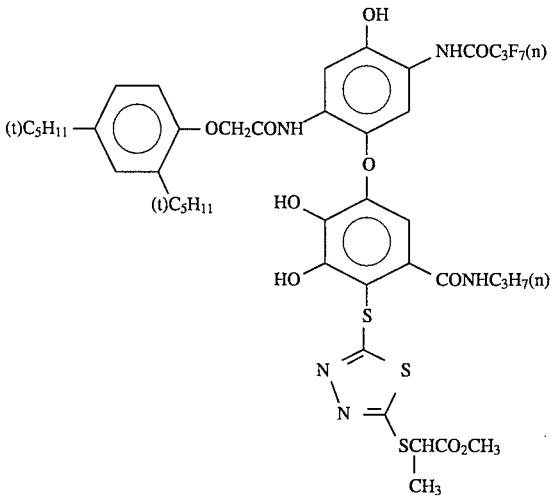

-continued
ExM-1
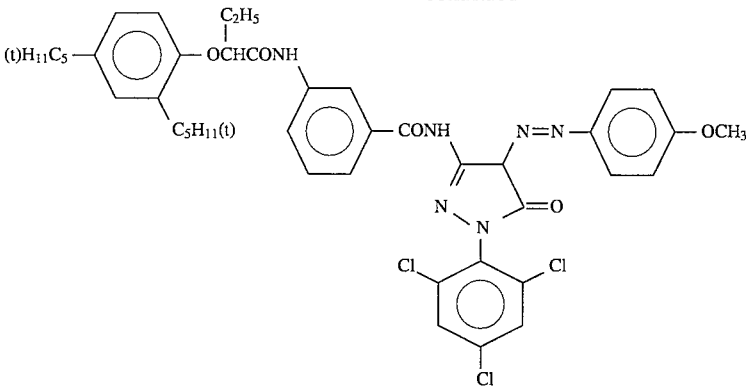
ExM-2
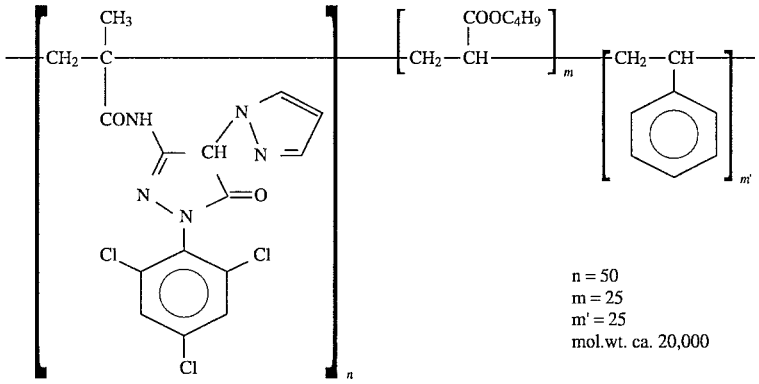
ExM-3
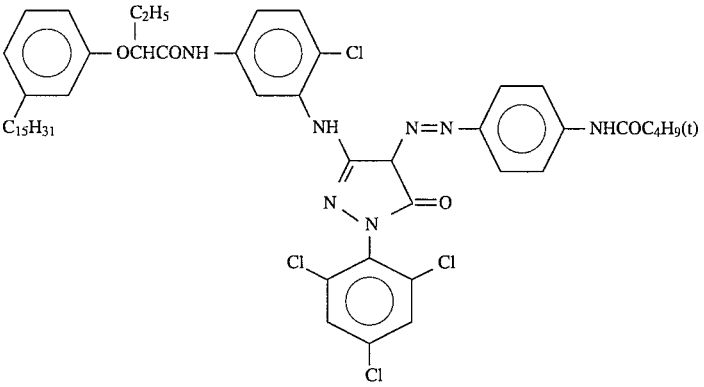
ExM-4
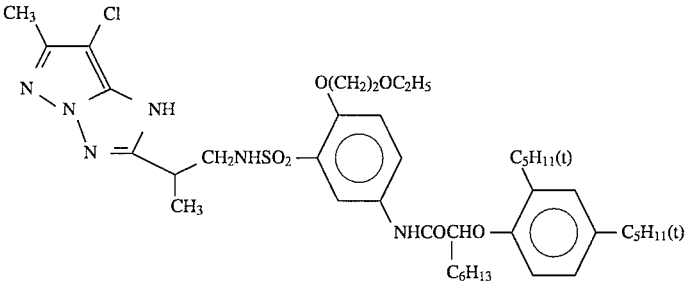

-continued
ExM-5
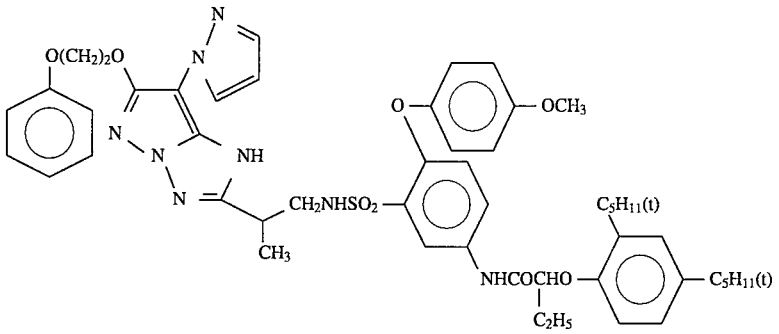
ExY-1
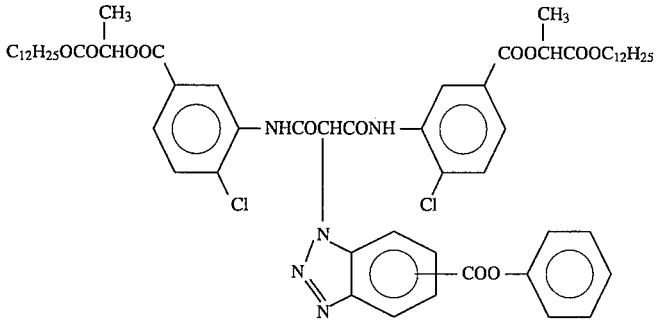
ExY-2
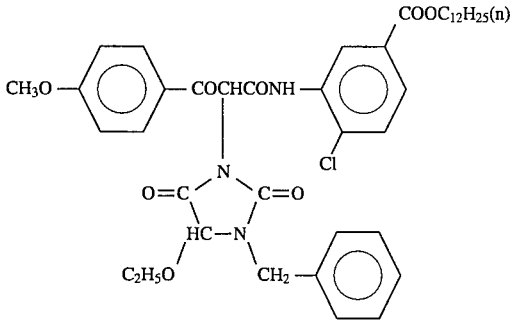
ExY-3
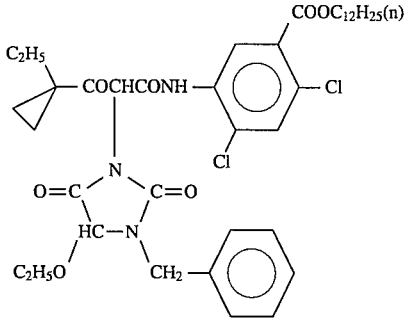
ExY-4
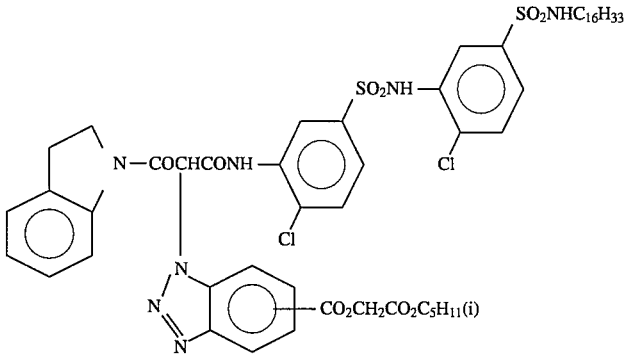

-continued
ExY-5
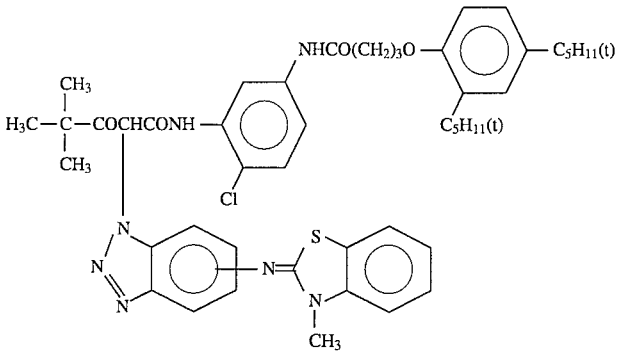
ExF-1
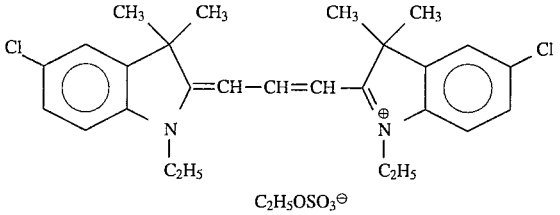
ExF-2
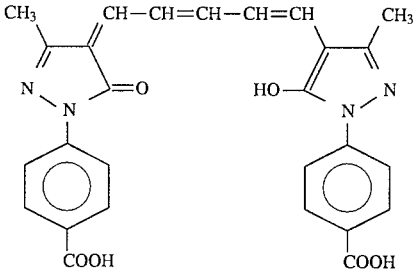
ExF-3
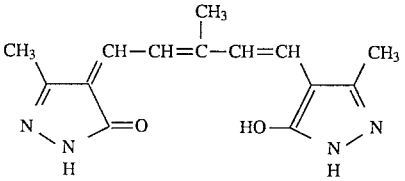
ExF-4
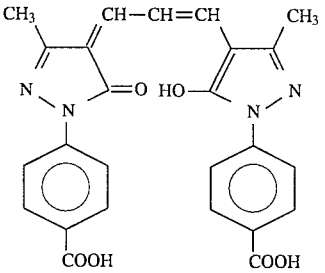
ExF-5
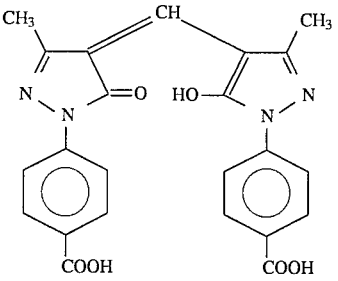

-continued
ExF-6
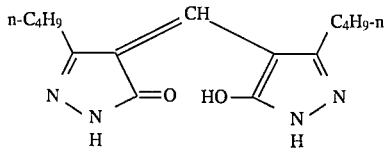
ExF-7
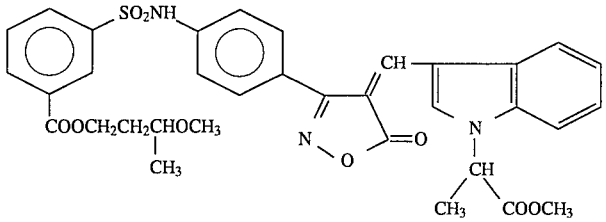
Cpd-1
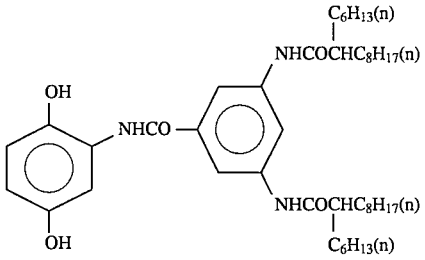
Cpd-2
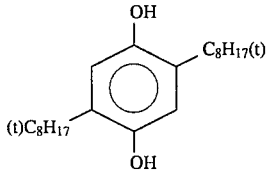
UV-1
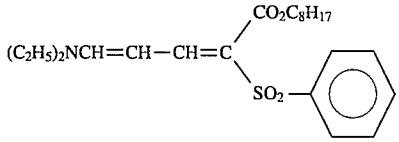
UV-2:
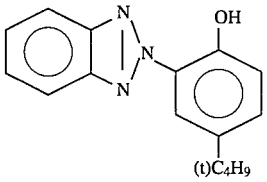
UV-3:
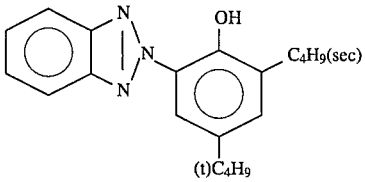
HBS-1:
Tricresyl phosphate
HBS-2:
Di-n-butyl phthalate -continued
HBS-3:
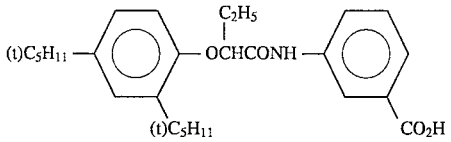
HBS-4:
Tri(2-ethylhexyl) phosphate
ExS-1
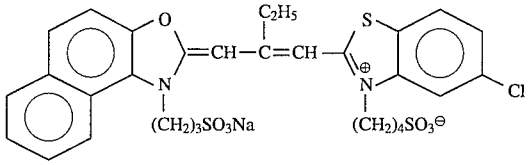
ExS-2
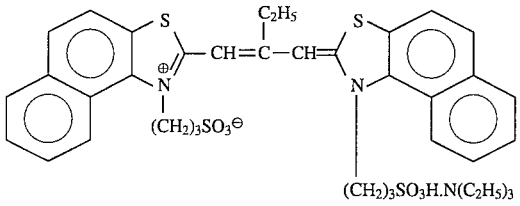
ExS-3
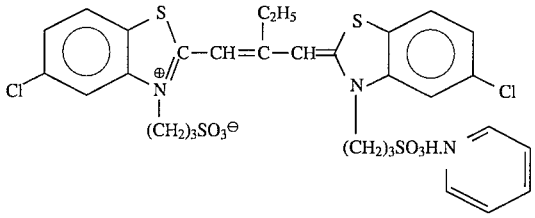
ExS-4
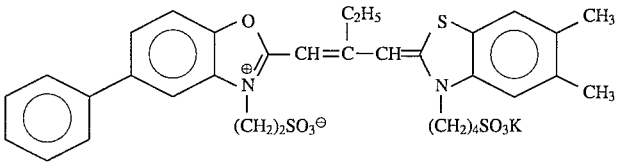
ExS-5
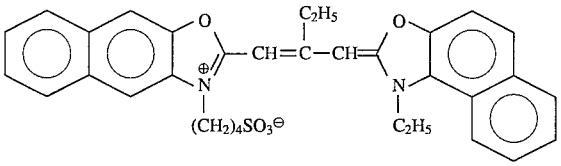
ExS-6
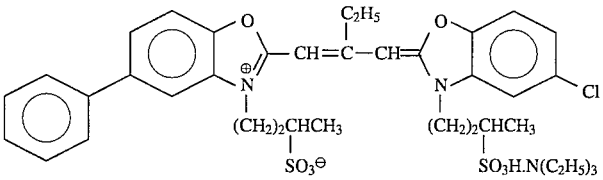
ExS-7
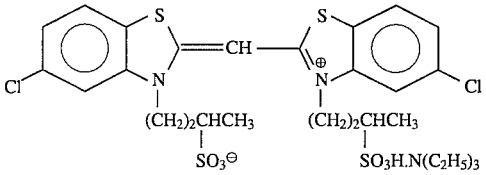

-continued
S-1
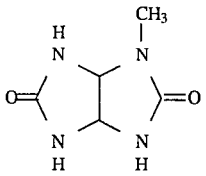
H-1
$CH_2{=}CH{-}SO_2{-}CH_2{-}CONH{-}CH_2$
$CH_2{=}CH{-}SO_2{-}CH_2{-}CONH{-}CH_2$
B-1
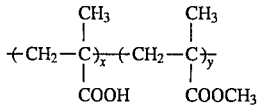
x/y = 10/90 (mol %)
B-2
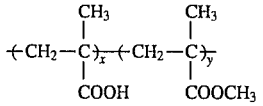
x/y = 40/60 (mol %)
B-3
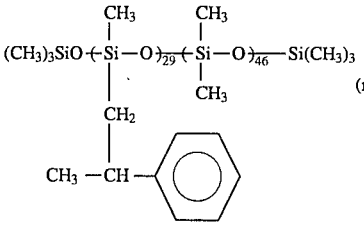
(mol %)
B-4
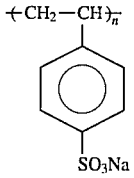
(n = an integer of ca. 1,000)
B-5
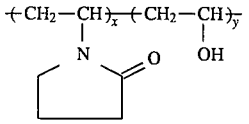
x/y = 70/30 (mol %)
B-6
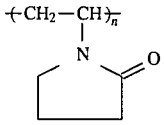
(mol. wt. ca. 10,000)
(n = an integer)
W-1
$C_8F_{17}SO_2NHCH_2CH_2CH_2OCH_2CH_2\overset{\oplus}{N}(CH_3)_3$
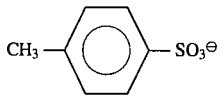
W-2
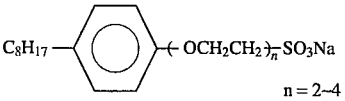
n = 2–4
W-3
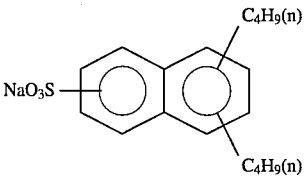

-continued
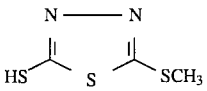
F-1
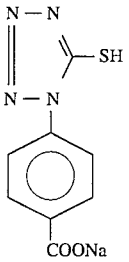
F-2
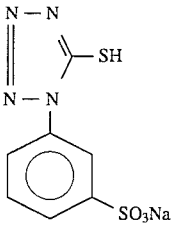
F-3
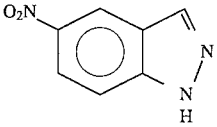
F-4
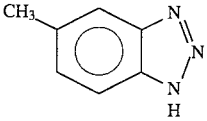
F-5
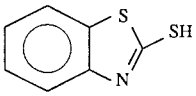
F-6
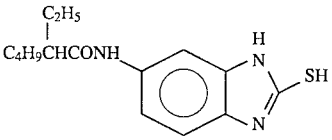
F-7
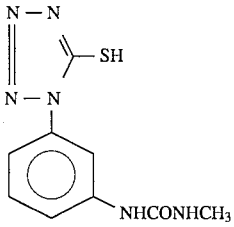
F-8
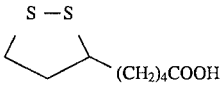
F-9
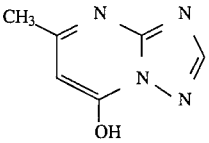
F-10

-continued

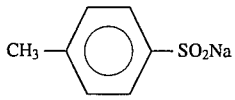

F-11

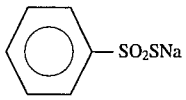

F-12

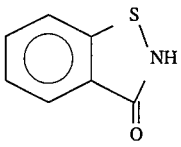

F-13

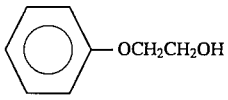

F-14

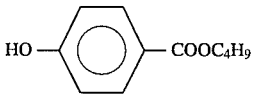

F-15

Preparation of Samples 102 to 113:

Samples 102 to 113 were prepared in the same manner as for sample 101, except that the support shown in Table 3 was used and the radical scavenger shown in Table 3 was added to the layers shown in the amount shown.

Each of samples (length: 50 cm) was uniformly exposed to white light and processed according to Processing 1 described below. The densities of the processed sample were measured, and processing unevenness was judged from the difference between the maximum yellow density and the minimum yellow density.

Each unexposed sample was processed according to Processing 2 described below and allowed to stand at 60° C. and 80% RH for 7 days. The difference between the yellow density after the standing and that before the standing was taken as stain with time.

Changes in photographic performance with time after photographing up to development processing were examined as follows.

A set of two films per sample were wedgewise exposed to white light. One of the films was preserved in a nitrogen atmosphere, with the other in an oxygen atmosphere, both at 30° C. and 55% RH for 15 days and then processed according to Processing 1. Yellow, magenta and cyan densities of each of the film having been preserved at 30° C., 55% RH in nitrogen and the film having been preserved at 30° C., 55% RH in oxygen per set were measured, and the logarithm of the reciprocal of the exposure providing a density of (minimum density+0.5) for each color was taken as a sensitivity. The difference in sensitivity between the film having been preserved in nitrogen and the film having been preserved in oxygen was taken as a measure of changes in photographic performance.

Pictures were taken on each sample film, cut to a width of 35 mm, with a camera, and the film was processed as follows at a rate of 1 $m^2$/day for 15 days. The processing was conducted by means of an automatic developing machine FP-560B, manufactured by Fuji Photo Film Co., Ltd.

The processing steps and compositions of the processing solutions are shown below.

Processing 1:

| Step | Time | Temp. | Rate of Replenishment* | Tank Volume |
|---|---|---|---|---|
| Color development | 3 min 5 sec | 38.0° C. | 23 ml | 17 l |
| Bleach | 50 sec | 38.0° C. | 5 ml | 5 l |
| Blix | 50 sec | 38.0° C. | — | 5 l |
| Fixing | 50 sec | 38.0° C. | 16 ml | 5 l |
| Washing | 50 sec | 38.0° C. | 34 ml | 3.5 l |
| Stabilization (1) | 20 sec | 38.0° C. | — | 3 l |
| Stabilization (2) | 20 sec | 38.0° C. | 20 ml | 3 l |
| Drying | 1 min 30 sec | 60° C. | | |

Note:
*Per 1.1 meter of a 35 mm wide photographic material (corresponding to a 24-exposure roll)

Stabilization was carried out in a counter-current system from (2) toward (1). All the overflow from the washing tank was introduced into the fixing bath. A cutout was made at the upper part of the bleaching tank and the fixing tank in the automatic developing machine so that all the overflow from these tanks might flow into the blix bath. The amount of processing solutions carried over to the next bath, i.e., the developer carried over to the bleaching bath, the bleaching solution carried over to the blix step, the blix bath carried over to the fixing step, and the fixer carried over to the washing step was 2.5 ml, 2.0 ml, 2.0 ml, and 2.0 ml, respectively, per 1.1 m×35 mm width. The cross-over time between every two steps was 6 seconds, and it was included in the processing time of the former step.

Compositions of the processing solutions used are described below.

| Color Developer: | Running Solution (g) | Replenisher (g) |
|---|---|---|
| Diethylenetriaminepentaacetic acid | 2.0 | 2.0 |
| 1-Hydroxyethylidene-1,1-diphosphonic acid | 2.0 | 2.0 |
| Sodium sulfite | 3.9 | 5.1 |
| Potassium carbonate | 37.5 | 39.0 |

-continued

| Color Developer: | Running Solution (g) | Replenisher (g) |
|---|---|---|
| Potassium bromide | 1.4 | 0.4 |
| Potassium iodide | 1.3 mg | — |
| Hydroxylamine sulfate | 2.4 | 3.3 |
| 2-Methyl-4-[N-ethyl-N-(β-hydroxyethyl)amino]aniline sulfate | 4.5 | 6.0 |
| Water to make | 1.0 l | 1.0 l |
| pH (adjusted with potassium hydroxide and sulfuric acid) | 10.05 | 10.15 |

| Bleaching Solution: | Running Solution (g) | Replenisher (g) |
|---|---|---|
| Ammonium 1,3-diaminopropanetetraacetato ferrate monohydrate | 130 | 195 |
| Ammonium bromide | 70 | 105 |
| Ammonium nitrate | 14 | 21 |
| Hydroxyacetic acid | 25 | 38 |
| Acetic acid | 40 | 60 |
| Water to make | 1.0 l | 1.0 l |
| pH (adjusted with aqueous ammonia) | 4.4 | 4.0 |

Blix Bath:

A 15:85 (by volume) mixture of the above bleaching solution and the following fixer (pH=7.0).

| Fixer: | Running Solution (g) | Replenisher (g) |
|---|---|---|
| Ammonium sulfite | 19 | 57 |
| Ammonium thiosulfate aqueous solution (700 g/l) | 280 ml | 840 ml |
| Imidazole | 15 | 45 |
| Ethylenediaminetetraacetic acid | 15 | 45 |
| Water to make | 1.0 l | 1.0 l |
| pH (adjusted with aqueous ammonia and acetic acid) | 7.4 | 7.45 |

Washing Solution:

Prepared by passing tap water through a mixed bed column packed with an H type strongly acidic cation-exchange resin AMBERLITE IR-120B, produced by Rohm & Haas Co., and an OH type strongly basic anion-exchange resin AMBERLITE IRA-400, produced by Rohm & Haas Co., to reduce the Ca and Mg ions each to 3 mg/l or lower and then adding to the treated water 20 mg/l of sodium dichloroisocyanurate and 150 mg/l of sodium sulfate. The resulting washing solution had a pH between 6.5 and 7.5.

Stabilizer:

Common to running solution and replenisher:

Sodium p-toluenesulfinate 0.03 g

Polyoxyethylene p-monononylphenyl ether (average degree of polymerization: 10) 0.2 g Disodium ethylenediaminetetraacetate 0.05 g 1,2,4-Triazole 1.3 g 1,4-Bis(1,2,4-triazol-1-ylmethyl)piperazine 0.75 g Water to make 1.0 l pH 8.5

Processing 2 is the same as Processing 1, except for changing the washing time to 15 seconds, the stabilization (1) time to 15 seconds, and the stabilization (2) time to 10 seconds.

The results of the above measurements and evaluation are shown in Table 3.

TABLE 3

| Sample | Support | | | Radical Scavenger | | | Stain | Processing | Change in Sensitivity With Time from Exposure to Development | | | |
|---|---|---|---|---|---|---|---|---|---|---|---|---|
| No. | Kind | Tg (°C.) | Heat Treatment | Kind | Layers | Amount (g/m²) | with Time | Unevenness | Yellow | Magenta | Cyan | Remark |
| 101 | TAC | — | none | — | — | — | +0.16 | 0.00 | +0.06 | +0.07 | +0.04 | Comparison |
| 102 | " | — | none | B-3 | 1st to 14th | 0.04 in total | +0.15 | 0.00 | +0.03 | +0.03 | +0.01 | " |
| 103 | PEN | 119 | none | — | — | — | +0.04 | 0.04 | +0.09 | +0.10 | +0.11 | " |
| 104 | PEN | " | 110° C./48 hrs | — | — | — | +0.04 | 0.00 | +0.11 | +0.12 | +0.13 | " |
| 105 | " | " | " | B-3 | 1st to 14th | 0.04 in total | +0.02 | 0.00 | +0.02 | +0.02 | +0.02 | Invention |
| 106 | " | " | " | RS-1 | 1st to 14th | 0.07 in total | +0.04 | 0.00 | +0.05 | +0.06 | +0.07 | " |
| 107 | " | " | " | A-5 | 1st to 14th | 0.07 in total | +0.03 | 0.00 | +0.03 | +0.03 | +0.03 | " |
| 108 | " | " | " | B-1 | 1st to 14th | 0.06 in total | +0.01 | 0.00 | +0.02 | +0.01 | +0.02 | " |
| 109 | " | " | " | B-10 | 5th<br>9th<br>12th | 0.03<br>0.03<br>0.02 | +0.02 | 0.00 | +0.02 | +0.03 | +0.02 | |
| 110 | " | " | " | A-15 | 5th<br>9th | 0.09<br>0.09 | +0.02 | 0.00 | +0.02 | +0.03 | +0.02 | |

TABLE 3-continued

| Sample No. | Support Kind | Support Tg (°C.) | Support Heat Treatment | Radical Scavenger Kind | Radical Scavenger Layers | Radical Scavenger Amount (g/m²) | Stain with Time | Processing Unevenness | Change in Sensitivity With Time from Exposure to Development Yellow | Magenta | Cyan | Remark |
|---|---|---|---|---|---|---|---|---|---|---|---|---|
| | | | | | 12th | 0.07 | | | | | | |
| 111 | PET | 80 | 75° C./24 hrs | B-3 | 1st to 14th | 0.04 in total | +0.03 | 0.00 | +0.03 | +0.03 | +0.02 | " |
| 112 | " | " | " | B-10 | 5th | 0.03 | +0.02 | 0.00 | +0.03 | +0.03 | +0.02 | " |
| | | | | | 9th | 0.03 | | | | | | |
| | | | | | 12th | 0.02 | | | | | | |
| 113 | " | " | " | — | — | — | +0.05 | 0.00 | +0.11 | +0.13 | +0.14 | Comparison |

As is apparent from Table 3, stain with time can be reduced by replacing TAC with PET or PEN as a support, but the replacement with PET or PEN results in increase in processing unevenness and increase in change of photographic performance (change of sensitivity) with time after exposure to development. Although the processing unevenness can be reduced by subjecting the PET or PEN support to a heat treatment, the heat treatment results in further increase in change of photographic performance with time after exposure to development. It can be seen that the change in photographic performance can be avoided by addition of a radical scavenger. The radical scavengers represented by formula (A) or (B) exert particularly great effects. The results also reveal that addition of a radical scavenger brings about reduction of stain with time.

EXAMPLE 2

Samples were prepared in the same manner as for samples 105, 108 and 111 of Example 1, except that radical scavenger RS-2 shown below was further added to the 3rd, 4th, and 5th layers in amounts of 0.03 g/m², 0.03 g/m² and 0.05 g/m², respectively, and evaluated in the same manner as in Example 1. As a result, the change in cyan sensitivity with time from exposure to development was further reduced to give more satisfactory results.

Radical Scavenger RS-2:

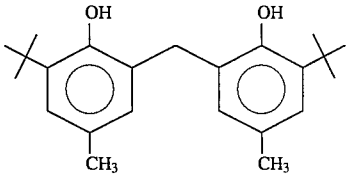

RS-2 has a galvinoxyl decoloration rate constant of 8.3 $mmol^{-1}s^{-1}dm^3$.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one photographic layer, wherein at least one of said photographic layers contains at least one radical scavenger compound represented by formula (A):

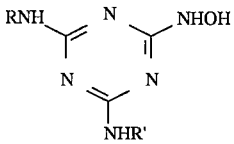

(A)

wherein R and R', which may be the same or different, each represent an alkyl group or an aryl group; provided that when R and R' are the same unsubstituted alkyl group, the alkyl group contains 7 or more carbon atoms, or represented by formula (B):

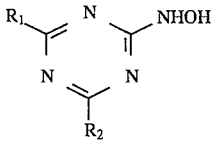

(B)

wherein $R_1$ and $R_2$, which may be the same or different, each represent a hydroxylamino group, a hydroxyl group, an amino group, an alkylamino group, an arylamino group, an alkoxy group, an aryloxy group, an alkylthio group, an arylthio group, an alkyl group or an aryl group, provided that $R_1$ and $R_2$ do not simultaneously represent —NHR, wherein R is an alkyl group or an aryl group;

wherein, said radical scavenger compound is present in an amount necessary to provide resistance to staining with time, and resistance to processing unevenness and change in sensitivity from the time of exposure to development of the photographic material, and said support comprises a poly(alkylene aromatic dicarboxylate) whose glass transition point is from 50° to 200° C. and has been subjected to a heat treatment at a temperature of lower than the glass transition point thereof and not lower than 40° C. either before formation of a subbing layer or after formation of a subbing layer and before formation of a silver halide emulsion layer.

2. A silver halide color photographic material as claimed in claim 1, wherein said poly(alkylene aromatic dicarboxylate) is a polyester essentially comprising a benzenedicarboxylic acid or a naphthalenedicarboxylic acid and a diol.

3. A silver halide color photographic material as claimed in claim 2, wherein the polyester is polyethylene terephthalate or polyethylene naphthalate.

4. A silver halide color photographic material as claimed in claim 1, wherein the poly(alkylene aromatic dicarboxylate) support has a thickness of 80 to 90 μm.

* * * * *